US006351065B2

(12) United States Patent
Yamazaki et al.

(10) Patent No.: US 6,351,065 B2
(45) **Date of Patent: *Feb. 26, 2002**

(54) IMAGE FORMING APPARATUS FOR FORMING IMAGE BY ELECTRON IRRADIATION

(75) Inventors: Koji Yamazaki, Atsugi; Masahiro Fushimi, Zama; Hideaki Mitsutake, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,922

(22) Filed: Mar. 30, 1998

(30) Foreign Application Priority Data

Mar. 31, 1997 (JP) ..... 9-081281
Mar. 20, 1998 (JP) ..... 10-071858

(51) Int. Cl.[7] ..... H01J 1/62; H01J 63/04; H01J 1/46; H01J 21/10; H01J 1/16

(52) U.S. Cl. ..... 313/497; 313/306; 313/351; 313/495; 313/336; 313/422

(58) Field of Search ..... 313/422, 295, 313/253, 256, 258, 268, 306–308, 309, 310, 336, 351, 495–97, 283, 285; 315/169.1, 169.3, 169.4

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,424,605 | A | 6/1995 | Lovoi | 313/422 |

(List continued on next page.)

FOREIGN PATENT DOCUMENTS

| | | | |
|---|---|---|---|
| EP | 0523702 | A1 | 4/1993 |
| EP | 0690472 | A1 | 11/1996 |
| JP | 63-274047 | | 11/1988 |
| JP | 64-31332 | | 2/1989 |
| JP | 2-257551 | | 10/1990 |
| JP | 3-55738 | | 3/1991 |
| JP | 4-28137 | | 1/1992 |
| JP | 5-266807 | | 10/1993 |

(List continued on next page.)

OTHER PUBLICATIONS

C.A. Mead, "Operation of Tunnel–Emission Devices," Journal of Applied Physics, vol. 32, No. 4, pp. 646–652 (Apr. 1961).

C.A. Spindt, et al., "Physical Properties of Thin–Film Field Emission Cathodes with Molybdenum Cones," Journal of Applied Physics, vol. 47, No. 12, pp. 5248–5263 (Dec. 1976).

W.P. Dyke, et al., "Field Emission," Advances in Electronics and Electron Physics, vol. VIII, pp. 89–185 (1956).

(List continued on next page.)

*Primary Examiner*—Vip Patel
*Assistant Examiner*—Mack Haynes
(74) *Attorney, Agent, or Firm*—Fitzpatrick, Cella, Harper & Scinto

(57) ABSTRACT

A support member (20) for maintaining the distance between a face plate (30) and a rear plate (31) is interposed between the face plate (30) and the rear plate (31). An insulating film is formed on the support member (20) or its surface. An intermediate layer (21) is formed at a portion near the rear plate (31). The intermediate layer (21) is set at a low resistance and the same potential as that of the rear plate (31). As a result, an electron beam emitted from an electron-emitting portion near the support member (20) follows an orbit which is directed temporarily away from the support member and then comes close to the support member near the face plate (30) due to the steady charge-up of the support member. Then, the electron beam is irradiated on a defined position on the face plate (30).

56 Claims, 23 Drawing Sheets

U.S. PATENT DOCUMENTS

| | | | | | |
|---|---|---|---|---|---|
| 5,477,105 | A | | 12/1995 | Curtin et al. | 313/422 |
| 5,532,548 | A | | 7/1996 | Spindt et al. | 313/422 |
| 5,541,473 | A | | 7/1996 | Duboc, Jr. et al. | 313/422 |
| 5,576,596 | A | | 11/1996 | Curtin et al. | 313/422 |
| 5,589,731 | A | | 12/1996 | Fahlen et al. | 313/495 |
| 5,597,518 | A | | 1/1997 | Lovoi | 264/1.12 |
| 5,614,781 | A | | 3/1997 | Spindt et al. | 313/422 |
| 5,667,418 | A | | 9/1997 | Fahlen et al. | 445/25 |
| 5,674,351 | A | | 10/1997 | Lovoi | 156/629.1 |
| 5,675,212 | A | | 10/1997 | Schmid et al. | 313/422 |
| 5,725,787 | A | | 3/1998 | Curtin et al. | 216/25 |
| 5,742,117 | A | * | 4/1998 | Spindt et al. | 313/495 X |
| 5,742,177 | A | | 4/1998 | Spindt et al. | 313/422 |
| 5,746,635 | A | | 5/1998 | Spindt et al. | 445/24 |
| 5,760,538 | A | | 6/1998 | Mitsutake et al. | 313/422 |
| 5,798,604 | A | | 8/1998 | Duboc, Jr. et al. | 313/495 |
| 5,828,352 | A | | 10/1998 | Nomura et al. | 345/74 |
| 5,859,502 | A | * | 1/1999 | Spindt et al. | 313/497 X |
| 5,865,930 | A | | 2/1999 | Schmid et al. | 156/265 |
| 5,916,396 | A | | 6/1999 | Schmid et al. | 156/89.16 |
| 5,936,343 | A | * | 8/1999 | Fushimi et al. | 313/495 |
| 5,987,067 | A | | 11/1999 | Schmid et al. | 156/89.16 |
| 6,157,123 | A | | 12/2000 | Schmid et al. | 313/422 |
| JP | | | 8-180821 | | 7/1996 |
| JP | | | 8-508846 | | 9/1996 |
| JP | | | 9-022649 | | 1/1997 |
| WO | | | WO 93/21650 | | 10/1993 |
| WO | | | WO 94/18694 | | 8/1994 |
| WO | | | WO 96/30926 | | 10/1996 |

OTHER PUBLICATIONS

M.I. Elinson, et al., "The Emission of Hot Electrons and the Field Emission of Electrons From Tin Oxide," Radio Engineering and Electronic Physics, pp. 1290–1296 (Jul. 1965).

G. Dittmer, "Electrical Conduction and Electron Emission of Discontinuous Thin Films," Thin Solid Films, vol. 9, pp. 317–328 (1972).

M. Hartwell, et al., "Strong Electron Emission From Patterned Tin–Indium Oxide Thin Films," International Electron Devices Meeting, pp. 519–521 (1975).

H. Araki, et al., "Electroforming and Electron Emission of Carbon Thin Films," Journal of the Vacuum Society of Japan, vol. 26, No. 1, pp. 22–29 (1983).

R. Meyer, et al., Recent Development on "Microtips" Display at LETI, Technical Digest of IVMC 91, pp. 6–9 (1991).

* cited by examiner

IMAGE FORMING APPARATUS FOR FORMING IMAGE BY ELECTRON IRRADIATION

BACKGROUND OF THE INVENTION

1. Field of the Invention

The present invention relates to an image forming apparatus such as a display apparatus using an electron beam and, more particularly, to an image forming apparatus having a support member (spacer) inside the envelope of the image forming apparatus.

2. Description of the Related Art

Conventionally, two types of devices, namely hot and cold cathode devices, are known as electron-emitting devices. Known examples of the cold cathode devices are surface-conduction emission (SCE) type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted from a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3$ $SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 20 is a plan view showing the surface-conduction emission type electron-emitting device by M. Hartwell et al. described above as a typical example of the device structures of these surface-conduction emission type electron-emitting devices. Referring to FIG. 20, numeral 3001 denotes a substrate; and 3004, a conductive thin film made of a metal oxide formed by sputtering. This conductive thin film 3004 has an H-shaped pattern, as shown in FIG. 20. An electron-emitting portion 3005 is formed by performing electrification processing (referred to as forming processing to be described later) with respect to the conductive thin film 3004. An interval L in FIG. 20 is set to 0.5 to 1 mm, and a width W is set to 0.1 mm. The electron-emitting portion 3005 is shown in FIG. 20 in a rectangular shape at almost the center of the conductive thin film 3004 for the sake of illustrative convenience. However, this does not exactly show the actual position and shape of the electron-emitting portion 3005.

In the above surface-conduction emission type electron-emitting devices by M. Hartwell et al. and the like, typically the electron-emitting portion 3005 is formed by performing electrification processing called forming processing for the conductive thin film 3004 before electron emission. That is, the forming processing is to form an electron-emitting portion by electrification. For example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 21 is a cross-sectional view showing a typical example of the FE type device structure (device by C. A. Spindt et al. described above). Referring to FIG. 21, numeral 3010 denotes a substrate; 3011, an emitter wiring layer made of a conductive material; 3012, an emitter cone; 3013, an insulating layer; and 3014, a gate electrode. In this device, a voltage is applied between the emitter cone 3012 and the gate electrode 3014 to emit electrons from the distal end portion of the emitter cone 3012.

As another FE type device structure, there is an example in which an emitter and a gate electrode are arranged on a substrate to be almost parallel to the surface of the substrate, in addition to the multilayered structure of FIG. 21.

A known example of the MIM type electron-emitting devices is described in C. A. Mead, "Operation of Tunnel-Emission Devices", J. Appl. Phys., 32,646 (1961). FIG. 22 shows a typical example of the MIM type device structure. FIG. 22 is a cross-sectional view of the MIM type electron-emitting device. Referring to FIG. 22, numeral 3020 denotes a substrate; 3021, a lower electrode made of a metal; 3022, a thin insulating layer having a thickness of about 100 A; and 3023, an upper electrode made of a metal and having a thickness of about 80 to 300 A. In the MIM type electron-emitting device, an appropriate voltage is applied between the upper electrode 3023 and the lower electrode 3021 to emit electrons from the surface of the upper electrode 3023.

Since the above-described cold cathode devices can emit electrons at a temperature lower than that for hot cathode devices, they do not require any heater. The cold cathode device therefore has a structure simpler than that of the hot cathode device and can be micropatterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater.

For this reason, applications of the cold cathode devices have enthusiastically been studied.

Of cold cathode devices, the above surface-conduction emission type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied. Regarding applications of surface-conduction emission type electron-emitting devices to, e.g., image forming apparatuses such as an image display apparatus and an image recording apparatus, electron-beam sources, and the like have been studied.

As an application to image display apparatuses, in particular, as disclosed in the U.S. Pat. No. 5,066,833 and Japanese Patent Laid-Open Nos. 2-257551 and 4-28137 filed by the present applicant, an image display apparatus using the combination of an surface-conduction emission type electron-emitting device and a fluorescent substance which emits light upon reception of an electron beam has been studied. This type of image display apparatus using the combination of the surface-conduction emission type electron-emitting device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyeretal. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

Of image display apparatuses using electron-emitting devices like the ones described above, a thin, flat display apparatus receives a great deal of attention as an alternative to a CRT (Cathode-Ray Tube) display apparatus because of a small space and light weight.

FIG. 23 is a perspective view of an example of a display panel for a flat image display apparatus where a portion of the panel is removed for showing the internal structure of the panel.

In FIG. 23, numeral 3115 denotes a rear plate; 3116, a side wall; and 3117, a face plate. The rear plate 3115, the side wall 3116, and the face plate 3117 form an envelope (airtight container) for maintaining the inside of the display panel vacuum.

The rear plate 3115 has a substrate 3111 fixed thereto, on which N×M cold cathode devices 3112 are provided (M, N=positive integer equal to "2" or greater, appropriately set in accordance with an object number of display pixels). As shown in FIG. 23, the N×M cold cathode devices 3112 are arranged with M row-direction wirings 3113 and N column-direction wirings 3114. The portion constituted with the substrate 3111, the cold cathode devices 3112, the row-direction wiring 3113, and the column-direction wiring 3114 will be referred to as "multi electron-beam source". At an intersection of the row-direction wiring 3113 and the column-direction wiring 3114, an insulating layer (not shown) is formed between the wirings, to maintain electrical insulation.

Further, a fluorescent film 3118 made of a fluorescent substance is formed under the face plate 3117. The fluorescent film 3118 is colored with red, green and blue, three primary color fluorescent substances (not shown). Black conductive material (not shown) is provided between the fluorescent substances constituting the fluorescent film 3118. Further, a metal back 3119 made of Al or the like is provided on the surface of the fluorescent film 3118 on the rear plate 3115 side.

In FIG. 23, symbolsDx1 to Dxm, Dy1 to Dyn, and Hv denote electric connection terminals for airtight structure provided for electrical connection of the display panel with an electric circuit (not shown). The terminals Dx1 to Dxm are electrically connected to the row-direction wiring 3113 of the multi electron-beam source; Dy1 to Dyn, to the column-direction wiring 3114; and Hv, to the metal back 3119.

The inside of the airtight container is exhausted at about $10^{-6}$ Torr. As the display area of the image display apparatus becomes larger, the image display apparatus requires a means for preventing deformation or damage of the ear plate 3115 and the faceplate 3117 caused by a difference in pressure between the inside and outside of the airtight container. If the deformation or damage is prevented by heating the rear plate 3115 and the face plate 3117, not only the weight of the image display apparatus increases, but also image distortion and parallax are caused when the user views the image from an oblique direction. To the contrary, in FIG. 23, the display panel comprises a structure support member (called a spacer or rib) 3120 made of a relatively thin glass to resist the atmospheric pressure. With this structure, the interval between the substrate 3111 on which the multi beam-electron source is formed, and the face plate 3117 on which the fluorescent film 3118 is formed is normally kept at submillimeters to several millimeters. As described above, the inside of the airtight container is maintained at high vacuum.

In the image display apparatus using the above-described display panel, when a voltage is applied to the cold cathode devices 3112 via the outer terminals Dx1 to Dxm and Dy1 to Dyn, electrons are emitted by the cold cathode devices 3112. At the same time, a high voltage of several hundreds V to several kV is applied to the metal back 3119 via the outer terminal Hv to accelerate the emitted electrons and cause them collide with the inner surface of the face plate 3117. Consequently, the respective fluorescent substances constituting the fluorescent film 3118 are excited to emit light, thereby displaying an image.

The above-mentioned electron beam apparatus of the image forming apparatus or the like comprises an envelope for maintaining vacuum inside the apparatus, an electron source arranged inside the envelope, a target on which an electron beam emitted by the electron source is irradiated, an acceleration electrode for accelerating the electron beam toward the target, and the like. In addition to them, a support member (spacer) for supporting the envelope from its inside against the atmospheric pressure applied to the envelope is arranged inside the envelope.

The display panel of this image display apparatus suffers the following problem.

Some of electrons emitted near the spacer strike the spacer, or ions produced by the action of emitted electrons attach to the spacer. Further, some of electrons which have reached the face plate are reflected and scattered to strike the spacer to charge the spacer. The orbits of electrons emitted by the cold cathode devices are changed by the charge-up of the spacer, and the electrons reach positions different from proper positions on the fluorescent substances. As a result, a distorted image is displayed near the spacer.

SUMMARY OF THE INVENTION

It is an object of the present invention to solve the problems of the support member.

The first aspect of an image forming apparatus according to the present invention has the following arrangement.

An image forming apparatus comprising a rear substrate having an electron-emitting device, a front substrate having an image forming member, and a support member for maintaining an interval between the rear substrate and the front substrate, is characterized in that the apparatus comprises an electrode for applying a deflection force in a direction away from the support member to an electron emitted by the electron-emitting device, the support member has insulating properties, and the electrode relaxes deflection of an electron emitted by the electron-emitting device toward the support member owing to the insulating properties of the support member. According to the present invention, since said support member has insulating properties, an electron emitted from said electron-emitting device is deflected toward said support member. In such a situation, the degree of the deflection toward the support member can be reduced by the deflection by providing said electrode with the support member in comparison with the degree of deflection without electrode. In other words, the distance between the position on the image forming member, to which the electron is irradiated, and the support member can controlled. The reduction of the degree of deflection can be controlled to the suitable degree by changing the length of the electrode.

The second aspect of the image forming apparatus according to the present invention has the following arrangement.

An image forming apparatus comprising a rear substrate having an electron-emitting device, a front substrate having an image forming member, and a support member for maintaining an interval between the rear substrate and the front substrate, is characterized in that the apparatus comprises an electrode for applying a deflection force in a direction away from the support member to an electron emitted by the electron-emitting device, the support member maintains a state in which a charge-up amount is substantially constant, and the electrode relaxes deflection of an electron emitted by the electron-emitting device toward the support member owing to charge-up of the support member. According to the present invention, since said support member has been charged up, an electron emitted from said electron-emitting device is deflected toward said support member. In such a situation, the degree of the deflection toward the support member can be reduced by deflection by providing said electrode with the support member in comparison with the degree of deflection without electrode. In other words, the distance between the position on the image forming member, to which the electron is irradiated, and the support member can controlled. The reduction of the degree of deflection can be controlled to the suitable degree by changing the length of the electrode.

In the present invention, the degree of the insulating properties of the support member, or the degree of the characteristic of maintaining the state in which the charge-up amount is substantially constant is set large enough to maintain the state in which the charge-up of the support member is almost stable in driving the electron-emitting device. More specifically, in an arrangement wherein the electron-emitting device is periodically driven, the above characteristic is a characteristic capable of suppressing a change in charge-up amount within the allowable range of a change in degree of deflection of an electron emitted by the electron-emitting device upon a change in charge-up amount of the support member during at least one period. In the first or second aspect, the electrode for applying the deflection force in the direction away from the support member to an electron emitted by the electron-emitting device is arranged, e.g., on the support member or between the support member and the electron-emitting device.

The third aspect of the image forming apparatus according to the present invention has the following arrangement.

An image forming apparatus comprising a rear substrate having an electron-emitting device, a front substrate having an image forming member, and a support member for maintaining an interval between the rear substrate and the front substrate, is characterized in that the support member has insulating properties, and comprises an electrode for applying a deflection force in a direction away from the support member to an electron emitted by the electron-emitting device.

The fourth aspect of the image forming apparatus according to the present invention has the following arrangement.

An image forming apparatus comprising a rear substrate having an electron-emitting device, a front substrate having an image forming member, and a support member for maintaining an interval between the rear substrate and the front substrate, is characterized in that the support member maintains a state in which a charge-up amount is substantially constant, and comprises an electrode for applying a deflection force in a direction away from the support member to an electron emitted by the electron-emitting device.

In the third or fourth aspect, the electrode of the support member relaxes deflection of an electron emitted by the electron-emitting device toward the support member owing to charge-up of the support member. That is, since said support member has been charged up, an electron emitted from said electron-emitting device is deflected toward said support member. In such a situation, the degree of the deflection toward the support member can be reduced by deflection by providing said electrode with the support member in comparison with the degree of deflection without electrode. In other words, the distance between the position on the image forming member, to which the electron is irradiated, and the support member can controlled. The reduction of the degree of deflection can be controlled to the suitable degree by changing the length of the electrode.

In the respective aspects described above, the electrode may be connected to wiring arranged on the rear substrate. In the respective aspects described above, a low potential is preferably applied to the electrode for deflecting the electron in the direction away from the support member. This electrode is desirably set at a low resistance in order to prevent the low potential of the electrode on the rear substrate from increasing toward the front substrate.

In the respective aspects described above, the electrode of the support member or the electrode arranged between the support member and the electron-emitting device is set at a low potential in order to allow the electrode to apply a force for deflecting an electron emitted by the electron-emitting device in the direction away from the support member. More specifically, the electrode enables the equipotential plane to have a normal line in the direction away from the support member.

In the respective aspects described above, the support member preferably comprises the electrode, and the electrode is preferably arranged on a portion of the support member near the rear substrate and is not arranged on a side near the front substrate over a predetermined position on the support member. A low potential is preferably applied to the electrode in order to deflect an electron in the direction away from the support member. The predetermined position is a position where the probability of discharge can be decreased without posing any practical problem because discharge may occur due to a potential difference between a high potential on or near the front substrate and the potential of the electrode. More specifically, when a distance between the rear substrate and the front substrate is 0.5 mm to 10 mm, a size of a pixel formed on the front substrate upon reception of an emitted electron is 100 $\mu$m to 1 mm, and an accelerating voltage for accelerating an electron emitted by the electron-emitting device toward the image forming member is 1 to 15 kV, the predetermined position preferably corresponds to not more than ¼ to not less than 1/20 of the distance between the rear substrate and the front substrate.

In the respective aspects, the support member may comprise the electrode, and the electrode may be arranged to abut against the rear substrate. Particularly when the support member is arranged on wiring on the rear substrate, and the electrode is arranged to abut against the wiring, the support member can be satisfactorily connected to the rear substrate by arranging the electrode also on the abutment surface of the support member against the rear substrate.

In the respective aspects described above, the insulating properties of the support member or the characteristic of maintaining a state in which a charge-up amount is substantially saturated is given by a film formed on a surface of the support member. More specifically, the support member comprises a very-high-resistance film.

In the respective aspects described above, if the support member has a sheet resistance of not less than $10^{12}$ Ω/sq, the charged state of the support member can be kept almost stable.

In the respective aspects described above, the apparatus may further comprise a plurality of electron-emitting devices.

In the respective aspects described above, the apparatus may further comprise a plurality of electron-emitting devices arranged substantially linearly, and wherein the electrode causes deflection to such a degree as to set an interval between irradiation points, on the image forming member, of electrons emitted by, of the plurality of electron-emitting devices arranged substantially linearly, electron-emitting devices adjacent to each other via the support member to be almost equal to an interval between irradiation points, on the image forming member, of electrons emitted by electron-emitting devices adjacent to each other without mediacy of the support member. This arrangement is particularly suitable for suppressing distortion of an image to be formed.

In the respective aspects described above, the shape of the electrode can be selected from various shapes such as a layered shape and a block shape.

In the respective aspects described above, an acceleration electrode for applying a voltage for accelerating an electron emitted by the electron-emitting device toward the image forming member may be arranged. The acceleration electrode may be arranged on, e.g., the front substrate.

The principles of the present invention according to the present specification will be explained with reference to FIG. 1. FIG. 1 is a schematic cross-sectional view showing the basic structure of an image forming apparatus according to the present invention which is cut out along the line A—A' in FIG. 16. Numeral 31 denotes a rear plate including an electron source substrate; 30, a face plate including fluorescent substances and a metal back; 20, a spacer; 21, an electrode formed of a low-resistance film; 13, wiring; 25, an equipotential line; 111, a device; and 112, an electron beam orbit.

In this structure, the spacer is charged by an electron emitted by a device 111 near the spacer 20. This charge-up is saturated after a while upon the start of driving. The amount of charge-up is constant. In this case, the electron emitted by the device near the spacer travels in the direction to move apart from the spacer near the rear plate due to the presence of the electric field (like the one indicated by the equipotential lines 25) generated by the electrode 21. Then, the electron travels in the direction to come close to the spacer due to the presence of the electric field (like the one represented by the equipotential lines 25) generated by the charge-up near the face plate. As a result, the electron can reach a proper position to obtain an image free from distortion. Since no current flows through the spacer, the charges of the spacer are eliminated slowly. For example, the charges cannot be eliminated at about 60 Hz as a scanning interval for an NTSC image, and the potential distribution of the space is kept unchanged. Therefore, the electron always reaches the same position regardless of the electron emission amount, and thus an image free from fluctuation can be obtained.

The low-resistance electrode 21 (to be referred to as an intermediate layer hereinafter) of the spacer may extend to the abutment surface of the spacer against the electron source substrate, as shown in FIG. 2. In this case, the conductive state between the electron source substrate and the low-resistance electrode (intermediate layer) on the side surface of the spacer in contact with the electron source substrate can be preferably improved.

An insulating film 22 may be formed on the surface of the insulating member 20 serving as the spacer of the present invention, as shown in FIG. 3. If the secondary electron-emitting efficiency of the insulating film is lower than that of the spacer substrate, the charge-up amount becomes smaller than that in the case not using any insulating film. The electrode on the rear plate side can be suppressed low to increase the discharge breakdown voltage.

As shown in FIG. 4, another electrode (intermediate layer) for setting the spacer at the same potential as that of the face plate may be formed on the abutment surface of the spacer of the present invention against the face plate and the side surface of the spacer in contact with the face plate in order to suppress discharge at a small gap between the face plate and the spacer.

The image forming apparatus of the present invention has the following forms.

① The cold cathode device is a cold cathode device having a conductive film including an electron-emitting portion between a pair of electrodes, and preferably a surface-conduction emission type electron-emitting device.

② The electron source is an electron source having a simple matrix layout in which a plurality of cold cathode devices are wired in a matrix by a plurality of row-direction wirings and a plurality of column-direction wirings.

③ The electron source is an electron source having a ladder-shaped layout in which a plurality of rows (to be referred to as a row direction hereinafter) of a plurality of cold cathode devices arranged parallel and connected at two terminals of each device are arranged, and a control electrode (to be referred to as a grid hereinafter) arranged above the cold cathode devices along the direction (to be referred to as a column direction hereinafter) perpendicular to this wiring controls electrons emitted by the cold cathode devices.

④ According to the concepts of the present invention, the present invention is not limited to an image forming apparatus suitable for display. The above-mentioned image forming apparatus can also be used as a light-emitting source instead of a light-emitting diode for an optical printer made up of a photosensitive drum, the light-emitting diode, and the like. At this time, by properly selecting m row-direction wirings and n column-direction wirings, the image forming apparatus can be applied as not only a linear light-emitting source but also a two-dimensional light-emitting source. In this case, the image forming member is not limited to a substance which directly emits light, such as a fluorescent substance used in embodiments (to be described below), but may be a member on which a latent image is formed by charging of electrons.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

An embodiment of the present invention will be described in detail below with reference to the accompanying drawings.

<General Description of Image Display Apparatus>

First, the construction of a display panel of an image display apparatus to which the present invention is applied and a method for manufacturing the display panel will be described below.

Figure 16:
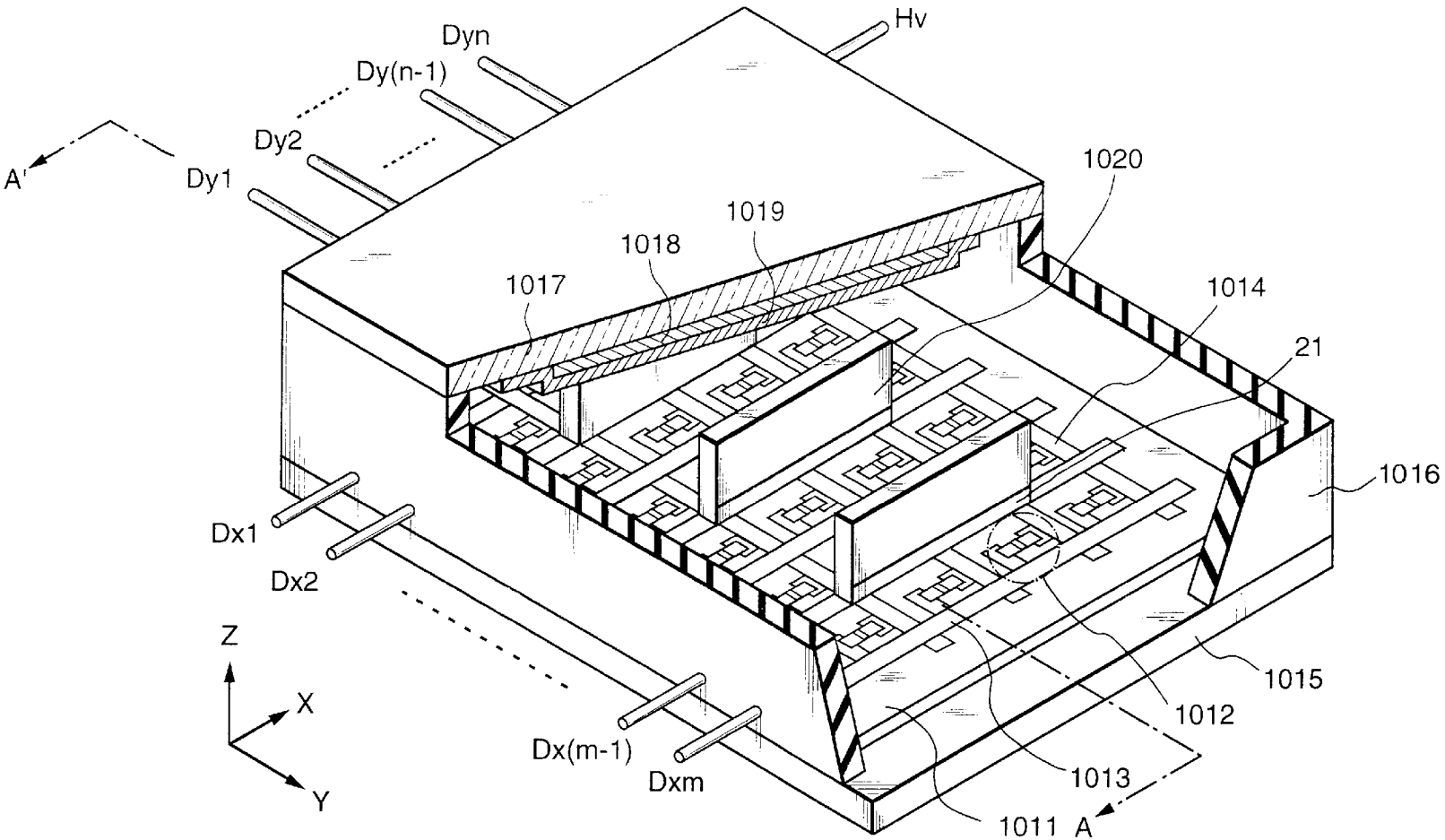
FIG. 16 is a partially cutaway perspective view showing the display panel of the image display apparatus in the embodiment.

FIG. 16 is a perspective view of the display panel where a portion of the panel is removed for showing the internal structure of the panel.

In FIG. 16, numeral 1015 denotes a rear plate; 1016, a side wall; and 1017, a face plate. These parts form an airtight container for maintaining the inside of the display panel vacuum. To construct the airtight container, it is necessary to seal-connect the respective parts to obtain sufficient strength and maintain airtight condition. For example, a frit glass is applied to junction portions, and sintered at 400 to 500° C. in air or nitrogen atmosphere, thus the parts are seal-connected. A method for exhausting air from the inside of the container will be described later. Since the inside of the airtight container is kept exhausted at about $10^{-6}$ Torr, a spacer 1020 including a low-resistance film 21 is arranged as a structure resistant to the atmospheric pressure in order to prevent damage of the airtight container caused by the atmospheric pressure or sudden shock.

The rear plate 1005 has a substrate 1011 fixed there, on which N×M cold cathode devices 1012 are provided (M, N=positive integer equal to "2" or greater, appropriately set in accordance with an object number of display pixels. For example, in a display apparatus for high-quality television display, desirably N=3000 or greater, M=1000 or greater. In this embodiment, N=3072, M=1024.). The N×M cold cathode devices 3112 are arranged with M row-direction wirings 1013 and N column-direction wirings 1014. The portion constituted with these parts 1011 to 1014 will be referred to as "multi electron-beam source".

In the multi electron-beam source used in the image display apparatus of the present invention, the material, shape, and manufacturing method of the cold cathode device are not limited as far as an electron source is prepared by wiring cold cathode devices in a simple matrix. Therefore, the multi electron-beam source can employ a surface-conduction emission (SCE) type electron-emitting device or an FE type or MIM type cold cathode device.

The structure of the multi electron-beam source prepared by arranging SCE type electron-emitting devices (to be described later) as cold cathode devices on a substrate and wiring them in a simple matrix will be described.

Figure 17:
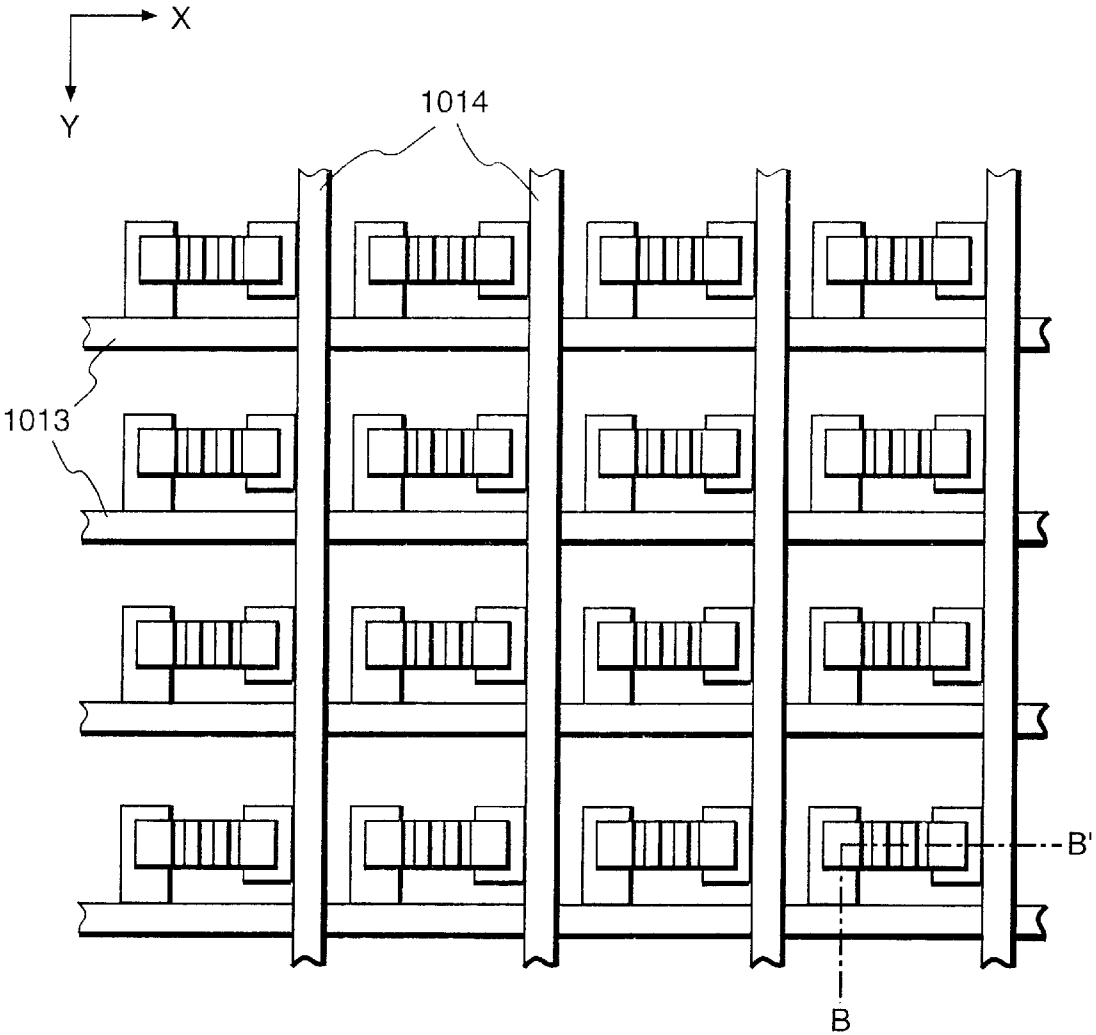
FIG. 17 is a plan view of the substrate of a multi electron-beam source in the embodiment.

FIG. 17 is a plan view of a multi electron-beam source used in the display panel in FIG. 16. SCE type electron-emitting devices like the one shown in FIGS. 9A and 9B (to be described later) are arranged on the substrate 1011. These devices are wired in a simple matrix by the row-direction wiring electrodes 1013 and the column-direction wiring electrodes 1014. At an intersection of each row-direction wiring electrode 1013 and the column-direction wiring electrode 1014, an insulating layer (not shown) is formed between the electrodes to maintain electrical insulation.

Figure 18:
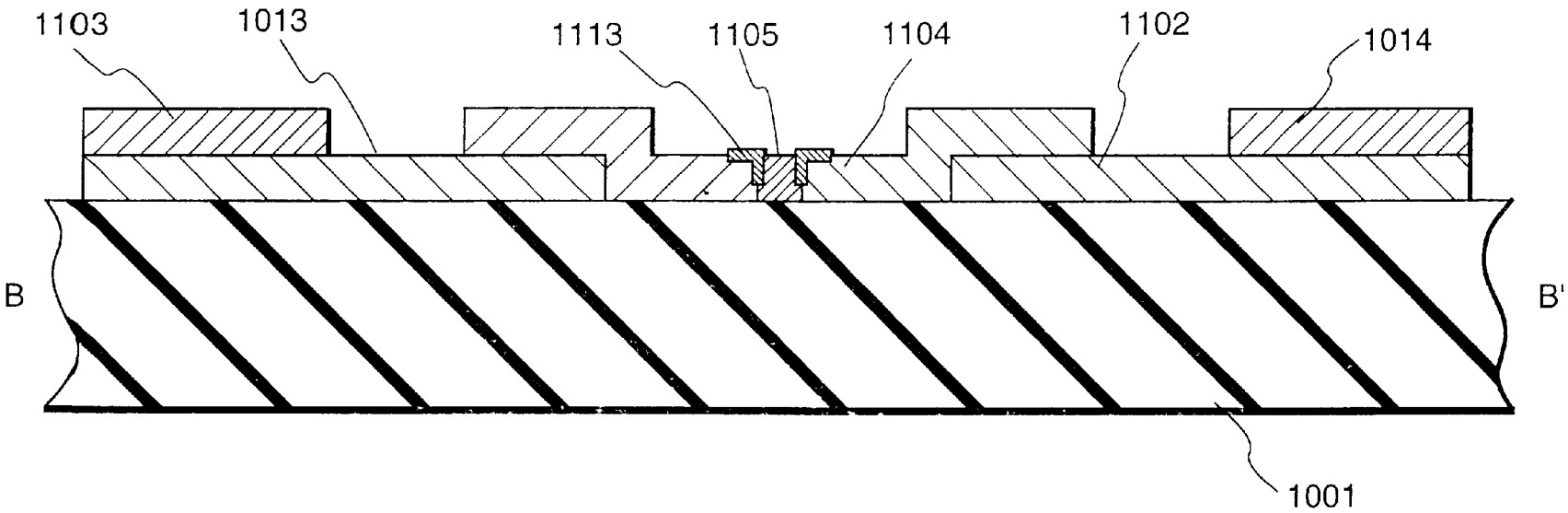
FIG. 18 is a partial cross-sectional view of the electron-emitting portion of the multi electron-beam source used in the embodiment.

FIG. 18 shows a cross-section cut out along the line B—B' in FIG. 17.

A multi electron-beam source having this structure is manufactured by forming the row-direction wiring electrodes 1013, the column-direction wiring electrodes 1014, an electrode insulating film (not shown), and device electrodes and conductive thin films of SCE type electron-emitting devices on the substrate in advance, and then supplying electricity to the devices via the row-direction wiring electrodes 1013 and the column-direction wiring electrodes 1014 to perform forming processing and activation processing (both of which will be described later).

In this embodiment, the substrate 1011 of the multi electron-beam source is fixed to the rear plate 1015 of the airtight container. However, if the substrate 1011 has sufficient strength, the substrate 1011 of the multi electron-beam source itself may be used as the rear plate of the airtight container.

Figure 8A:
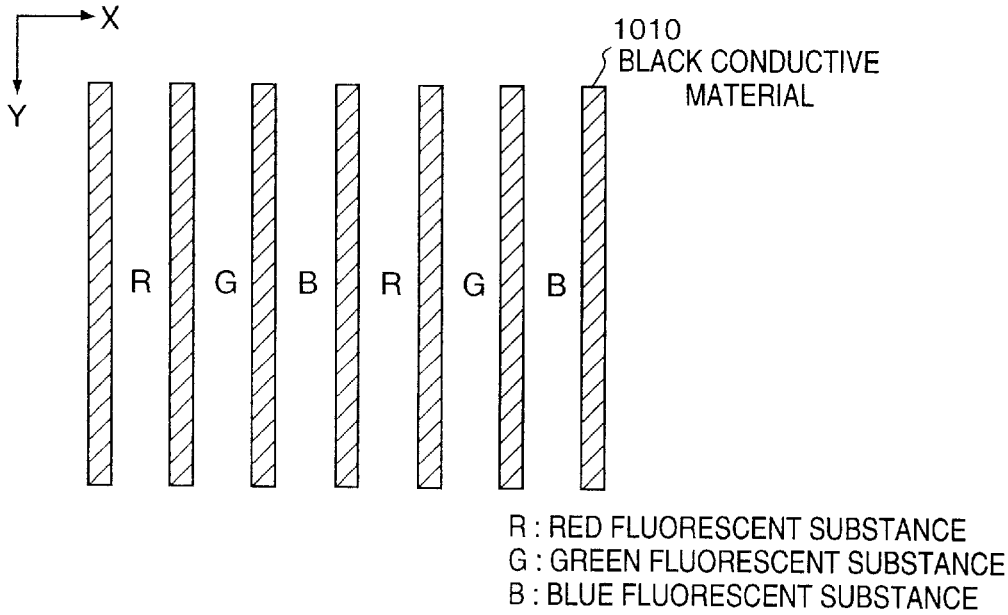
FIGS. 8A and 8B are plan views showing examples of the alignment of fluorescent substances on the face plate of a display panel.

Further, a fluorescent film 1018 is formed under the face plate 1017. As this embodiment is a color display apparatus, the fluorescent film 1018 is colored with red, green and blue three primary color fluorescent substances. The fluorescent substance portions are in stripes as shown in FIG. 8A, and black conductive material 1010 is provided between the stripes. The object of providing the black conductive material 1010 is to prevent shifting of display color even if electron-beam irradiation position is shifted to some extent, to prevent degradation of display contrast by shutting off reflection of external light, to prevent charge-up of the fluorescent film by electron beams, and the like. The black conductive material 1010 mainly comprises graphite, however, any other materials may be employed so far as the above object can be attained.

Figure 8B:
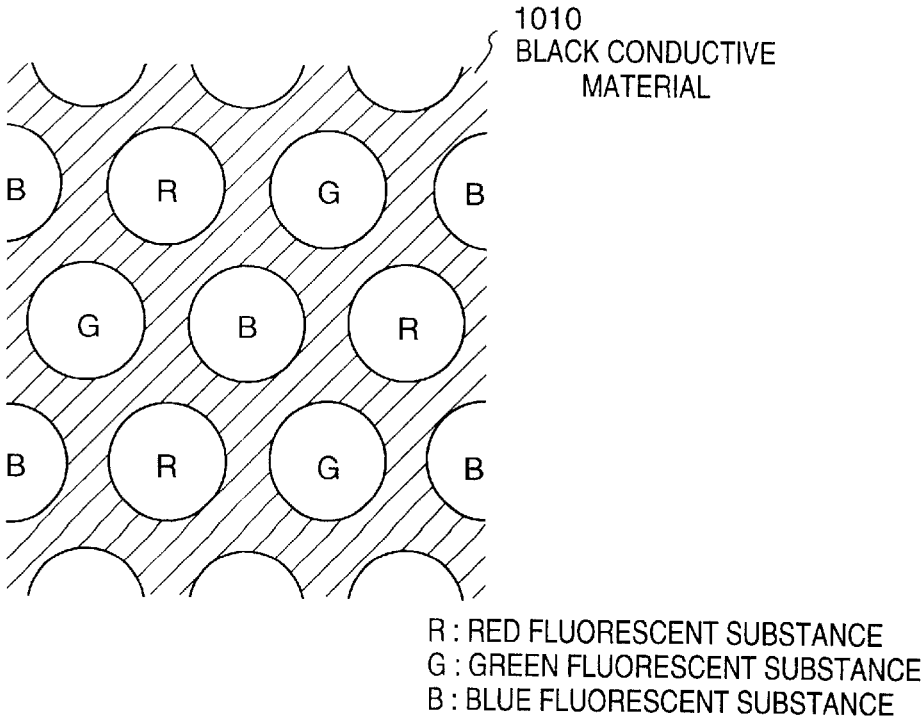

Further, three-primary colors of the fluorescent film is not limited to the stripes as shown in FIG. 8A. For example, delta arrangement as shown in FIG. 8B or any other arrangement may be employed.

Note that when a monochrome display panel is formed, a single-color fluorescent substance may be applied to the fluorescent film 1018, and the black conductive material may be omitted.

Further, a metal back 1019, which is well-known in the CRT field, is provided on the rear plate side surface of the fluorescent film 1018. The object of providing the metal back 1019 is to improve light-utilization ratio by mirror-reflecting a part of light emitted from the fluorescent film 1018, to protect the fluorescent film 1018 from collision between negative ions, to use the metal back 1019 as an electrode for applying an electron-beam accelerating voltage, to use the metal back 1019 as a conductive path for electrons which excited the fluorescent film 1018, and the like. The metal back 1019 is formed by, after forming the fluorescent film 1018 on the face plate 1017, smoothing the fluorescent film front surface, and vacuum-evaporating Al thereon. Note that in a case where the fluorescent film 1018 comprises fluorescent material for low voltage, the metal back 1019 is not used.

Further, for application of accelerating voltage or improvement of conductivity of the fluorescent film, transparent electrodes made of an ITO material or the like may be provided between the face plate 1017 and the fluorescent film 1018, although the embodiment does not employ such electrodes.

As an insulating member used for the spacer 1020, for example, a silica glass member, a glass member containing a small amount of an impurity such as Na, a soda-lime glass member, or a ceramic member consisting of alumina or the like is available. Note that the insulating member preferably has a thermal expansion coefficient near the thermal expansion coefficients of the airtight container and the substrate 1011.

<Control of Orbit of Emitted Electron>

Electrons emitted by the cold cathode devices 1012 follow the orbits formed in accordance with the potential distribution formed between the face plate 1017 and the substrate 1011. Electrons emitted by the cold cathode devices near the spacer may be subjected to constrains (changes in the positions of the wirings and the devices) accompanying the structure of the spacer. In this case, to form an image free from distortion and irregularity, the orbits of emitted electrons are controlled to irradiate the electrons at desired positions on the face plate 1017. By forming a low-resistance intermediate layer on the side surface portions of abutment surfaces of the spacer in contact with the face plate 1017 and the substrate 1011, the potential distribution near the spacer 1020 is allowed to have desired characteristics, thereby controlling the orbits of emitted electrons.

Figure 1:
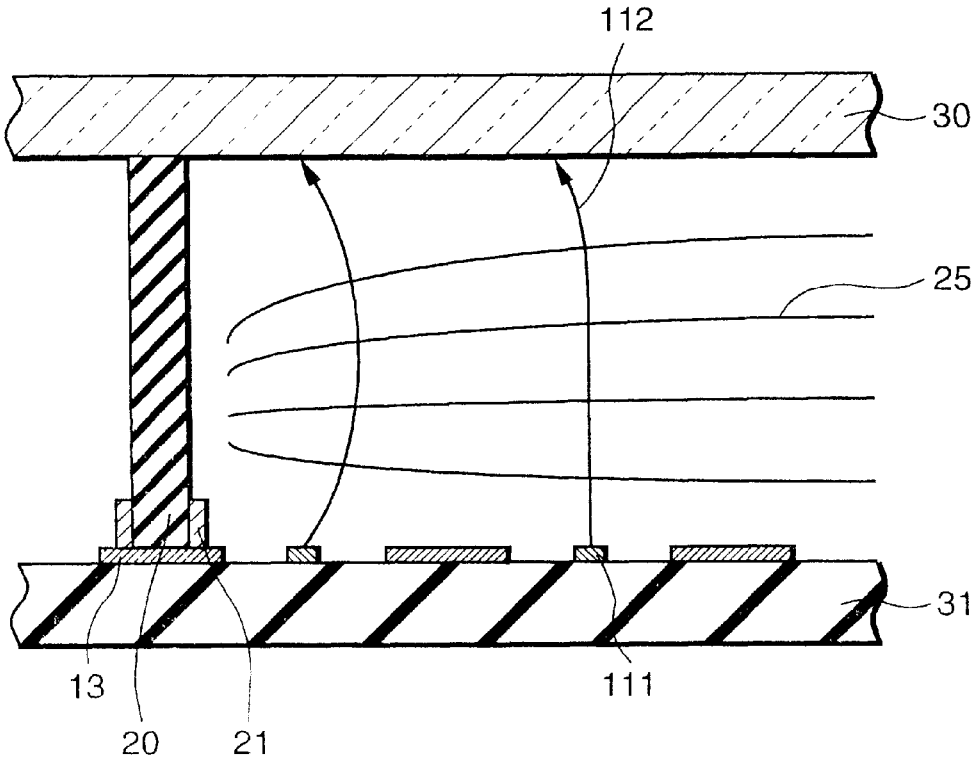
FIG. 1 is a view showing the structure of a spacer and the traveling orbit of an electron in an embodiment.

FIG. 1 is a cross-sectional view near a certain spacer. Referring to FIG. 1, numeral 21 denotes a low-resistance intermediate layer like the one described above. As a material for the low-resistance film 21, a material having a resistance sufficiently lower than that of an insulating member 20 constituting the spacer shown in FIG. 1 can be selected. For example, such a material is properly selected from metals such as Ni, Cr, Au, Mo, W, Pt, Ti, Al, Cu, and Pd, alloys thereof, printed conductors constituted by metals such as Pd, Ag, Au, $RuO_2$, and Pd-Ag or metal oxides and glass or the like, transparent conductors such as $In_2O_3$—$SnO_2$, and semiconductor materials such as polysilicon.

A joining material (not shown) needs to have conductivity to electrically connect the spacer to the row-direction wiring 1013 (13 in FIG. 1). That is, a conductive adhesive or frit glass containing metal particles or conductive filler is suitably used.

In FIG. 16, symbols Dx1 to Dxm, Dy1 to Dyn and Hv denote electric connection terminals for airtight structure provided for electrical connection of the display panel with an electric circuit (not shown). The terminals Dx1 to Dxm are electrically connected to the row-direction wiring 1013 of the multi electron-beam source; Dy1 to Dyn, to the column-direction wiring 1014 of the multi electron-beam source; and Hv, to the metal back 1019 of the face plate.

To exhaust air from the inside of the airtight container and make the inside vacuum, after forming the airtight container, an exhaust pipe and a vacuum pump (neither is shown) are connected, and air is exhausted from the airtight container to vacuum at about $10^{-7}$ Torr. Thereafter, the exhaust pipe is sealed. To maintain the vacuum condition inside of the airtight container, a getter film (not shown) is formed at a predetermined position in the airtight container immediately before/after the sealing. The getter film is a film formed by heating and evaporating getter material mainly including, e.g., Ba, by heating or high-frequency heating. The suctionattaching operation of the getter film maintains the vacuum condition in the container $1\times10^{-5}$ or $1\times10^{-7}$ Torr.

In the image display apparatus using the above display panel, when voltages are applied to the cold cathode devices 1012 via the outer terminals Dx1 to Dxm and Dy1 to Dyn, electrons are emitted by the cold cathode devices 1012. At the same time, a high voltage of several hundreds V to several kV is applied to the metal back 1019 via the outer terminal Hv to accelerate the emitted electrons to cause them collide with the inner surface of the face plate 1017. With this operation, the respective color fluorescent substances constituting the fluorescent film 1018 are excited to emit light, thereby displaying an image.

The voltage to be applied to each SCE type electron-emitting device 1012 as a cold cathode device in the present invention is normally set to about 12 to 16 V; a distance d between the metal back 1019 and the cold cathode device 1012, about 0.1 mm to 8 mm; and the voltage to be applied across the metal back 1019 and the cold cathode device 1012, about 0.1 kV to 10 kV.

The basic structure and manufacturing method of the display panel, and the general description of the image display apparatus according to the embodiment of the present invention have been described.

<Manufacturing Method of Multi Electron-Beam Source>

Next, the manufacturing method of the multi electron-beam source used in the display panel according to the embodiment of the present invention will be described. As far as the multi electron-beam source used in the image display apparatus is obtained by arranging cold cathode devices in a simple matrix, the material, shape, and manufacturing method of the cold cathode device are not limited. As the cold cathode device, therefore, an SCE type electron-emitting device or an FE type or MIM type cold cathode device can be used.

Under circumstances where inexpensive display apparatuses having large display screens are required, an SCE type electron-emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, an SCE type electron-emitting device can be manufactured by a relatively simple manufacturing method, and hence an increase in display area and a decrease in manufacturing cost can be attained. The present inventors have also found that among the SCE type electron-emitting devices, an electron-beam source where an electron-emitting portion or its peripheral portion comprises a fine particle film is excellent in electron-emitting characteristic and further, it can be easily manufactured. Accordingly, this type of electron-beam source is the most appropriate electron-beam source to be employed in a multi electron-beam source of a high luminance and large-screened image display apparatus. In the display panel of the embodiment, SCE type electron-emitting devices each having an electron-emitting portion or peripheral portion formed from a fine particle film are employed. First, the basic structure, manufacturing method and characteristic of the preferred SCE type electron-emitting device will be described, and the structure of the multi electron-beam source having simple-matrix wired SCE type electron-emitting devices will be described later.

<Preferred Structure and Manufacturing Method of SCE Device>

The typical structure of the SCE type electron-emitting device where an electron-emitting portion or its peripheral portion is formed from a fine particle film includes a flat type structure and a stepped type structure.

<Flat SEC Type Electron-Emitting Device>

Figure 9A:
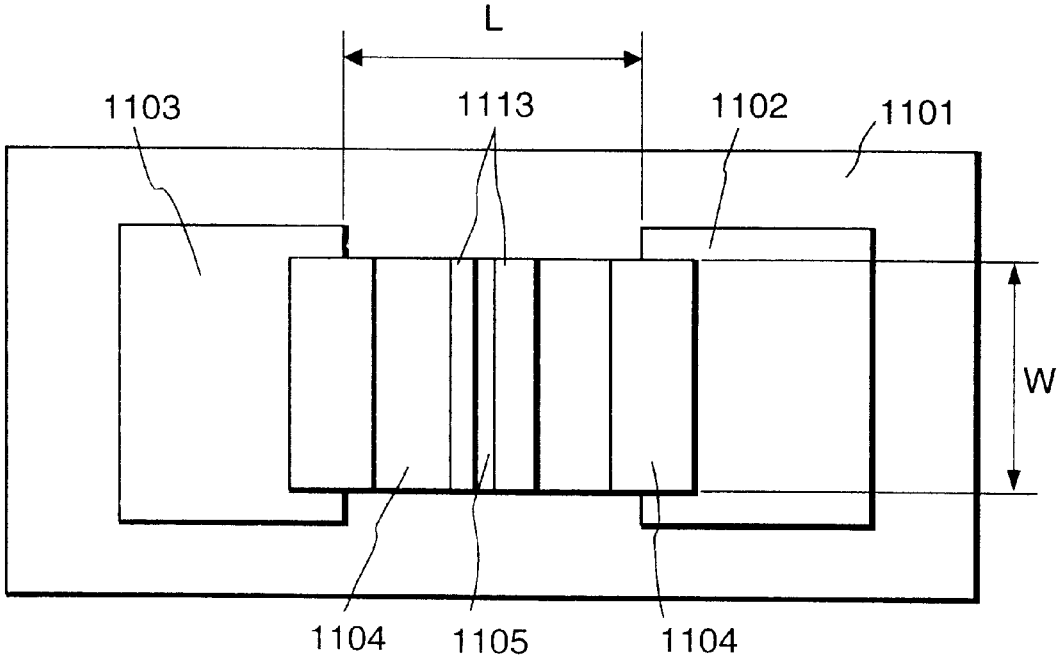
FIGS. 9A and 9B are a plan view and a cross-sectional view, respectively, of a flat surface-conduction emission type electron-emitting device used in the embodiment.
Figure 9B:
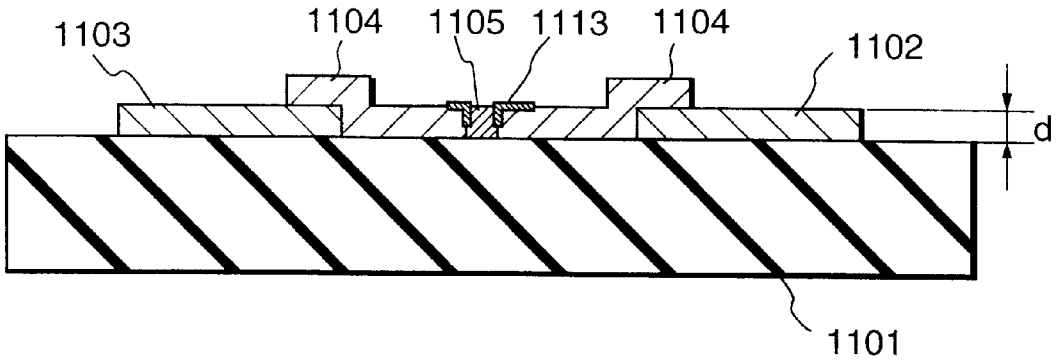

First, the structure and manufacturing method of a flat SCE type electron-emitting device will be described. FIG. 9A is a plan view explaining the structure of the flat SCE type electron-emitting device; and FIG. 9B, a cross-sectional view of the device. In FIGS. 9A and 9B, numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed of, e.g., $SiO_2$ thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. The electrode is easily formed by the combination of a film-forming technique such as vacuum-evaporation and a patterning technique such as photolithography or etching, however, any other method (e. g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds angstroms to hundreds micrometers. Most preferable range for a display apparatus is from several micrometers to tens micrometers. As for electrode thickness d, an appropriate value is selected from a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several angstroms to thousands angstroms. Preferably, the diameter is within a range from 10 angstroms to 200 angstroms. The thickness of the film is appropriately set in consideration of conditions as follows. That is, condition necessary for electrical connection to the device electrode 1102 or 1103, condition for the forming processing to be described later, condition for setting electric resistance of the fine particle film itself to an appropriate value to be described later etc. Specifically, the thickness of the film is set in a range from several angstroms to thousands angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to 10(Ω/sq).

As it is preferable that the conductive thin film 1104 is electrically connected to the device electrodes 1102 and 1103, they are arranged so as to overlap with each other at one portion. In FIG. 9B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron-emitting portion, therefore, FIGS. 9A and 9B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less. As it is difficult to exactly illustrate actual position or shape of the thin film 1113, FIGS. 9A and 9B show the film schematically. FIG. 9A shows the device where a part of the thin film 1113 is removed.

The preferred basic structure of SCE type electron-emitting device is as described above. In the embodiment, the device has the following constituents.

That is, the substrate 1101 comprises a soda-lime glass, and the device electrodes 1102 and 1103, an Ni thin film. The electrode thickness d is 1000 angstroms and the electrode interval L is 2 micrometers.

The main material of the fine particle film is Pd or PdO. The thickness of the fine particle film is about 100 angstroms, and its width W is 100 micrometers.

Next, a method of manufacturing a preferred flat SCE type electron-emitting device will be described with reference to FIGS. 10A to 10E which are cross-sectional views showing the manufacturing processes of the SCE type electron-emitting device. Note that reference numerals are the same as those in FIGS. 9A and 9B.

Figure 10A:
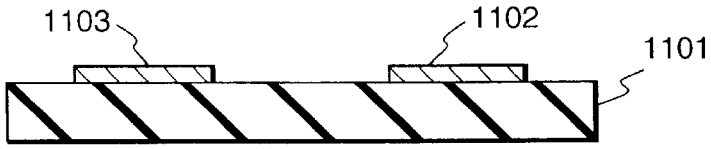
FIGS. 10A to 10E are views respectively showing the steps in manufacturing the flat surface-conduction emission type electron-emitting device.

(1) First, as shown in FIG. 10A, the device electrodes 1102 and 1103 are formed on the substrate 1101.

Upon formation of the electrodes 1102 and 1103, first, the substrate 1101 is fully washed with a detergent, pure water and an organic solvent, then, material of the device electrodes is deposited there (as a depositing method, a vacuum film-forming technique such as evaporation and sputtering may be used). Thereafter, patterning using a photolithography etching technique is performed on the deposited electrode material. Thus, the pair of device electrodes 1102 and 1103 shown in FIG. 10A are formed.

Figure 10B:
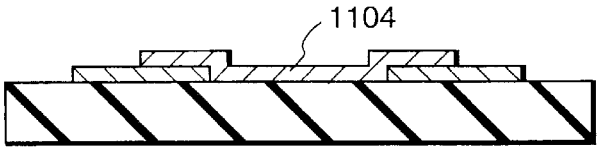

(2) Next, as shown in FIG. 10B, the conductive thin film 1104 is formed.

Upon formation of the conductive thin film 1104, first, an organic metal solvent is applied to the substrate 1101 in FIG. 10A, then the applied solvent is dried and sintered, thus forming a fine particle film. Thereafter, the fine particle film is patterned, in accordance with the photolithography etching method, into a predetermined shape. The organic metal solvent means a solvent of organic metal compound containing material of minute particles, used for forming the conductive thin film, as main component (i.e., Pd in this embodiment). In the embodiment, application of organic metal solvent is made by dipping, however, any other method such as a spinner method and spraying method may be employed.

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 10C:
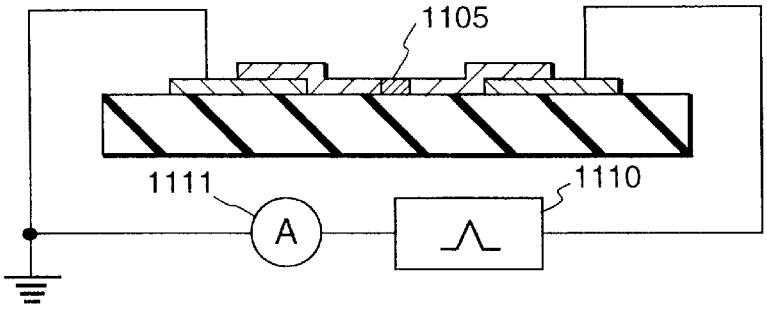

(3) Then, as shown in FIG. 10C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 formed of a fine particle film, to appropriately destroy, deform, or deteriorate a part of the conductive thin film, thus changing the film to have a structure suitable for electron emission. In the conductive thin film, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 11:
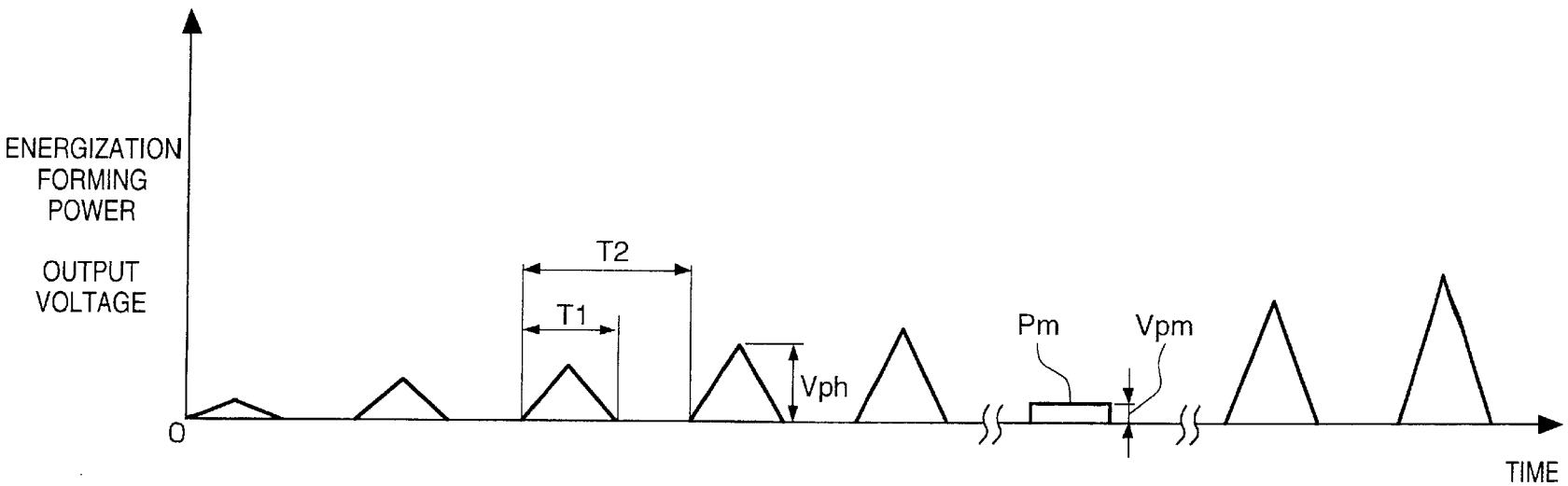
FIG. 11 is a graph showing the waveform of the application voltage in forming processing.

The forming processing will be explained in detail with reference to FIG. 11 showing an example of waveform of appropriate voltage applied from the forming power source 1110. Preferably, in case of forming a conductive thin film of a fine particle film, a pulse-form voltage is employed. In this embodiment, a triangular-wave pulse having a pulse width T1 is continuously applied at pulse interval of T2, as shown in FIG. 11. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this example, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electric resistance between the device electrodes 1102 and 1103 becomes $1\times10^6$ Ω, i.e., the current measured by the galvanometer 1111 upon application of monitor pulse becomes $1\times10^7$ A or less, the electrification of the forming processing is terminated.

Note that the above processing method is preferable to the SCE type electron-emitting device of this embodiment. In case of changing the design of the SCE type electron-emitting device concerning, e.g., the material or thickness of the fine particle film, or the device electrode interval L, the conditions for electrification are preferably changed in accordance with the change of device design.

Figure 10D:
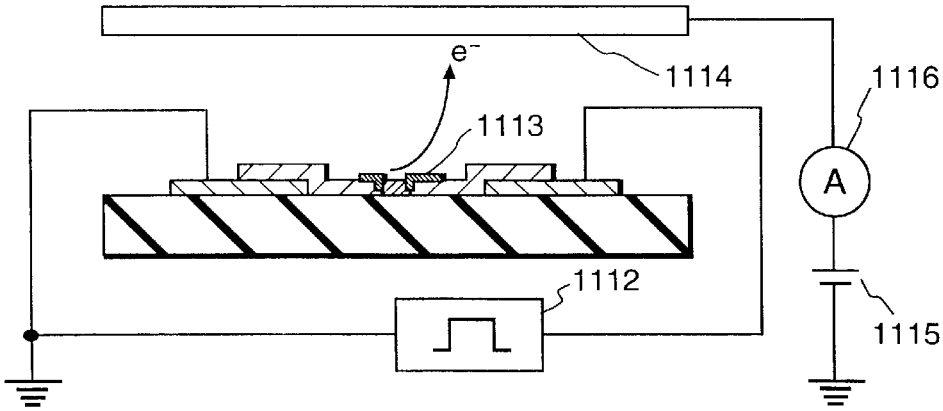

(4) Next, as shown in FIG. 10D, appropriate voltage is applied, from an activation power source 1112, between the device electrodes 1102 and 1103, and the activation processing is performed to improve electron-emitting characteristics obtained in the preceding step.

The activation processing here is electrification of the electron-emitting portion 1105, formed by the forming processing, on appropriate condition(s), for depositing carbon or carbon compound around the electron-emitting portion 1105 (In FIG. 10D, the deposited material of carbon or carbon compound is shown as material 1113). Comparing the electron-emitting portion 1105 with that before the activation processing, the emission current at the same applied voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 12A:
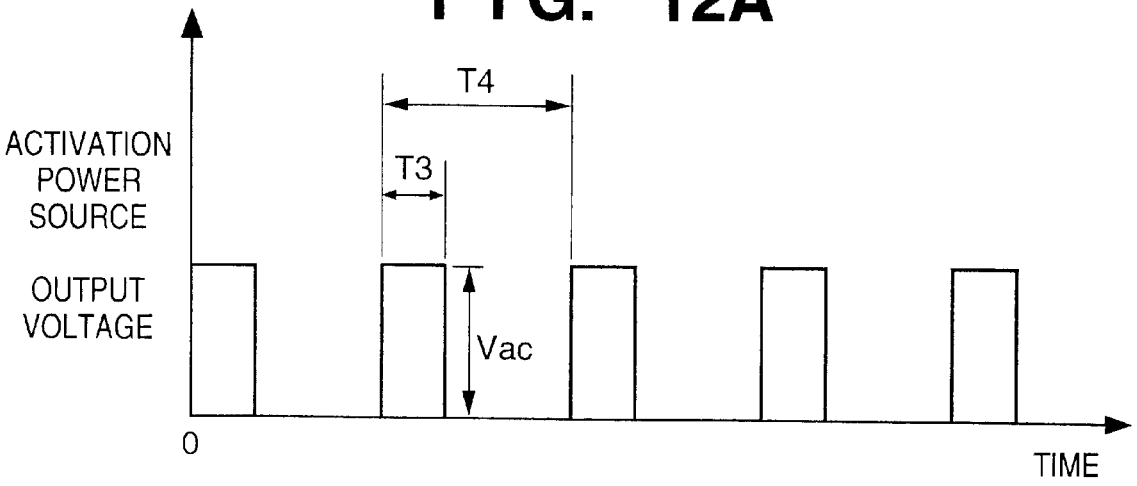
FIGS. 12A and 12B are graphs respectively showing the waveform of the application voltage and a change in emission current Ie in activation processing.

The activation processing will be described in more detail with reference to FIG. 12A showing an example of waveform of appropriate voltage applied from the activation power source 1112. In this example, a rectangular wave at a predetermined voltage is applied to perform the activation processing. More specifically, a rectangular-wave voltage Vac is set to 14 V; a pulse width T3, to 1 msec; and a pulse interval T4, to 10 msec. Note that the above electrification conditions are preferable for the SCE type electron-emitting device of the embodiment. In a case where the design of the SCE type electron-emitting device is changed, the electrification conditions are preferably changed in accordance with the change of device design.

Figure 12B:
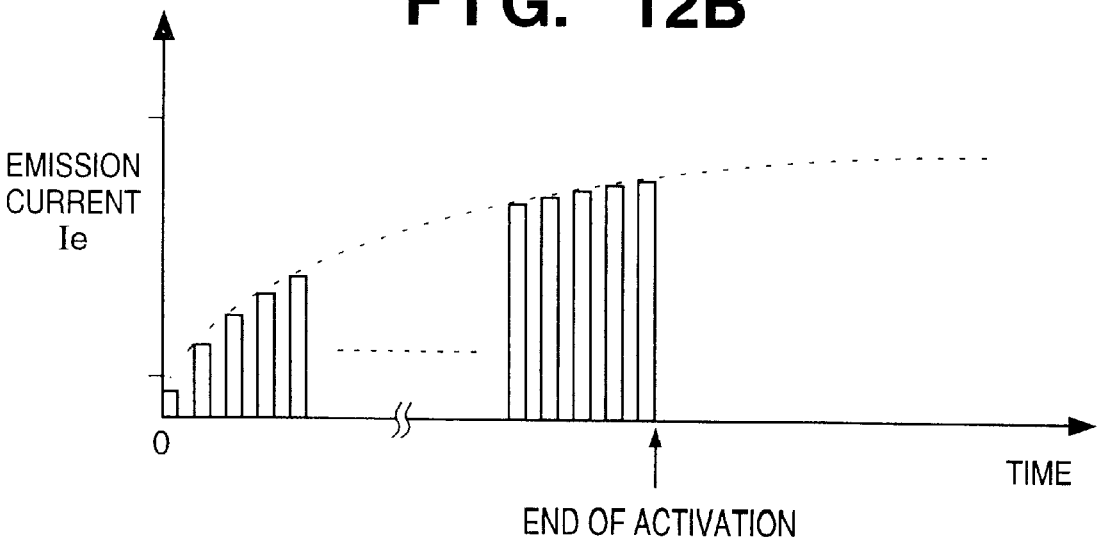

In FIG. 10D, numeral 1114 denotes an anode electrode, connected to a direct-current (DC) high-voltage power source 1115 and a galvanometer 1116, for capturing emission current Ie emitted from the SCE type electron-emitting device (in a case where the substrate 1101 is incorporated into the display panel before the activation processing, the Al layer on the fluorescent surface of the display panel is used as the anode electrode 1114). While applying voltage from the activation power source 1112, the galvanometer 1116 measures the emission current Ie, thus monitors the progress of activation processing, to control the operation of the activation power source 1112. FIG. 12B shows an example of the emission current Ie measured by the galvanometer 1116. In this example, as application of pulse voltage from the activation power source 1112 is started, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the SCE type electron-emitting device of the embodiment. In case of changing the design of the SCE type electron-emitting device, the conditions are preferably changed in accordance with the change of device design.

Figure 10E:
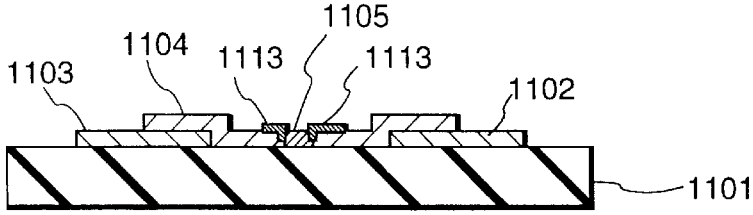

As described above, the SCE type electron-emitting device as shown in FIG. 10E is manufactured.

<Step SCE Type Electron-Emitting Device>

Next, another typical structure of the SCE type electron-emitting device where an electron-emitting portion or its peripheral portion is formed of a fine particle film, i.e., a stepped SCE type electron-emitting device will be described.

Figure 13:
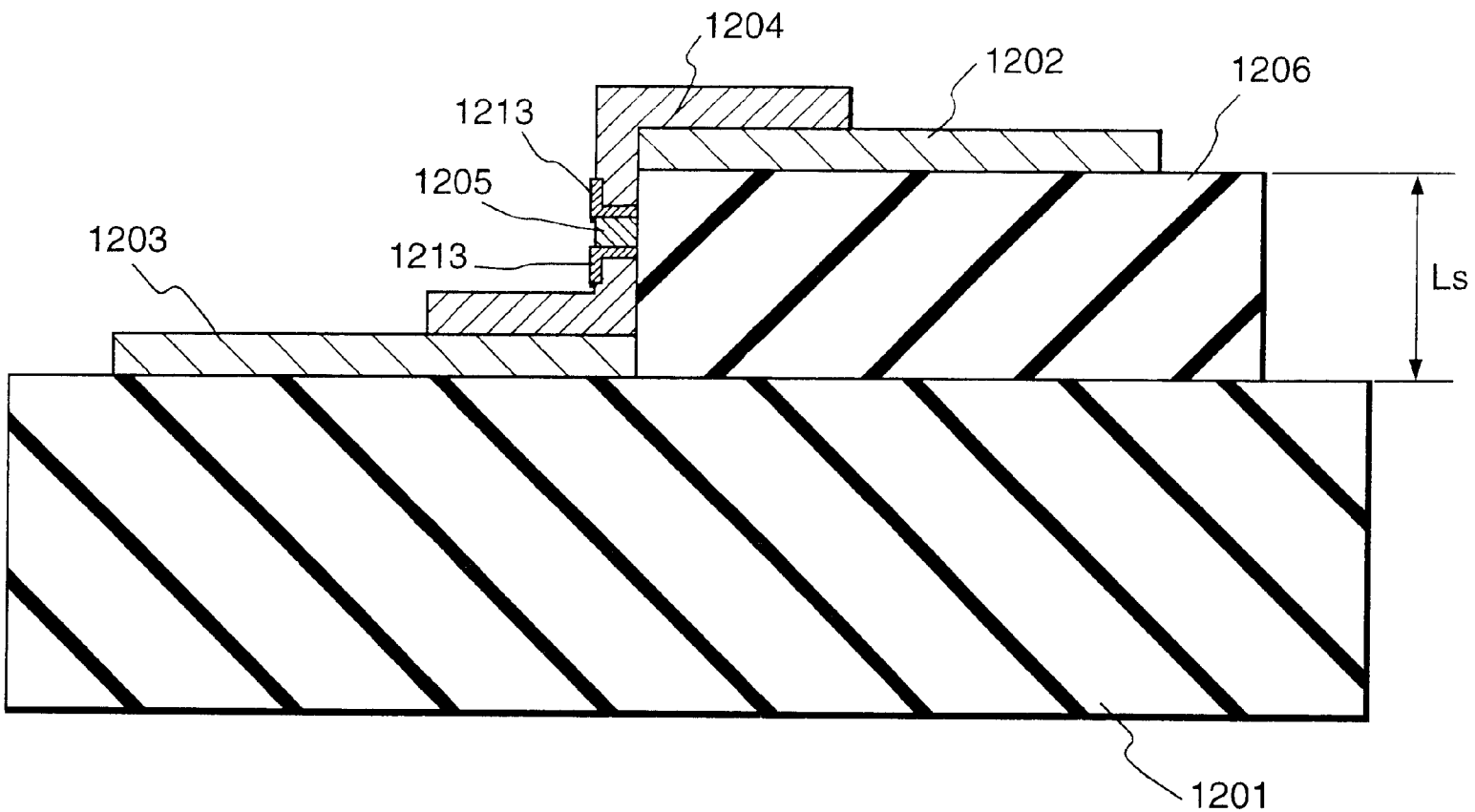
FIG. 13 is a cross-sectional view of a step surface-conduction emission type electron-emitting device used in the embodiment.

FIG. 13 is a cross-sectional view schematically showing the basic construction of the step SCE type electron-emitting device. In FIG. 13, numeral 1201 denotes a substrate; 1202 and 1203, device electrodes; 1206, a step-forming member for making height difference between the electrodes 1202 and 1203; 12 04, a conductive thin film using a fine particle film; 1205, an electron-emitting portion formed by the forming processing; and 1213, a thin film formed by the activation processing.

Difference between the step device structure from the above-described flat device structure is that one of the device electrodes (1202 in this example) is provided on the step-forming member 1206 and the conductive thin film 1204 covers the side surface of the step-forming member 1206. The device interval L in FIGS. 9A and 9B is set in this structure as a height difference Ls corresponding to the height of the step-forming member 1206. Note that the substrate 1201, the device electrodes 1202 and 1203, the conductive thin film 1204 using the fine particle film can comprise the materials given in the explanation of the flat SCE type electron-emitting device. Further, the step-forming member 1206 comprises electrically insulating material such as $SiO_2$.

Next, a method of manufacturing the stepped SCE type electron-emitting device will be described with reference FIGS. 14A to 14F which are cross-sectional views showing the manufacturing processes. In these figures, reference numerals of the respective parts are the same as those in FIG. 13.

Figure 14A:
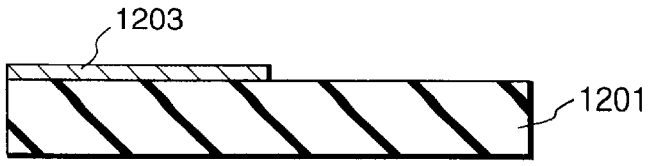
FIGS. 14A to 14F are views respectively showing the steps in manufacturing the step surface-conduction emission type electron-emitting device.

(1) First, as shown in FIG. 14A, the device electrode 1203 is formed on the substrate 1201.

Figure 14B:
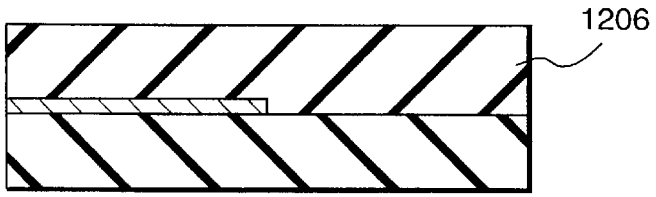

(2) Next, as shown in FIG. 14B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 14C:
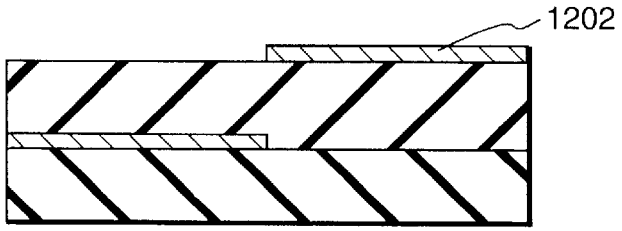

(3) Next, as shown in FIG. 14C, the device electrode 1202 is formed on the insulating layer.

Figure 14D:
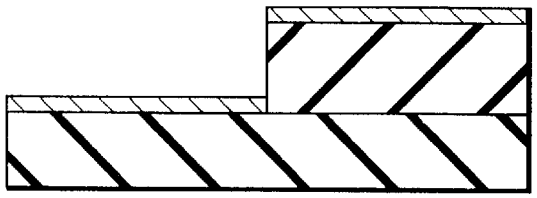

(4) Next, as shown in FIG. 14D, a part of the insulating layer is removed by using, e.g., an etching method, to expose the device electrode 1203.

Figure 14E:
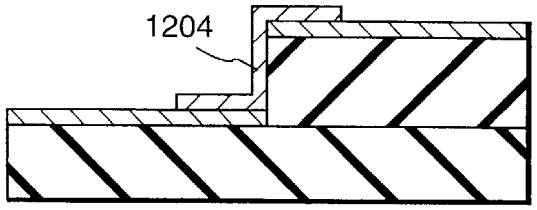

(5) Next, as shown in FIG. 14E, the conductive thin film 1204 using the fine particle film is formed. Upon formation, similar to the above-described flat device structure, a film-forming technique such as an applying method is used.

(6) Next, similar to the flat device structure, the forming processing is performed to form the electron-emitting portion 1205 (the forming processing similar to that explained using FIG. 10C may be performed).

(7) Next, similar to the flat device structure, the activation processing is performed to deposit carbon or carbon compound around the electron-emitting portion (activation processing similar to that explained using FIG. 10D may be performed).

Figure 14F:
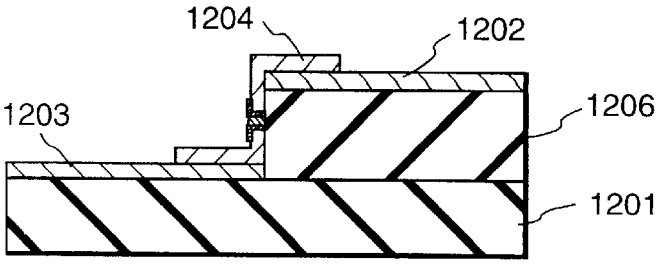

As described above, the stepped SCE type electron-emitting device shown in FIG. 14F is manufactured.

<Characteristic of SCE Type Electron-Emitting Device Used in Display Apparatus>

The structure and manufacturing method of the flat SCE type electron-emitting device and those of the stepped SCE type electron-emitting device are as described above. Next, the characteristic of the electron-emitting device used in the display apparatus will be described below.

Figure 15:
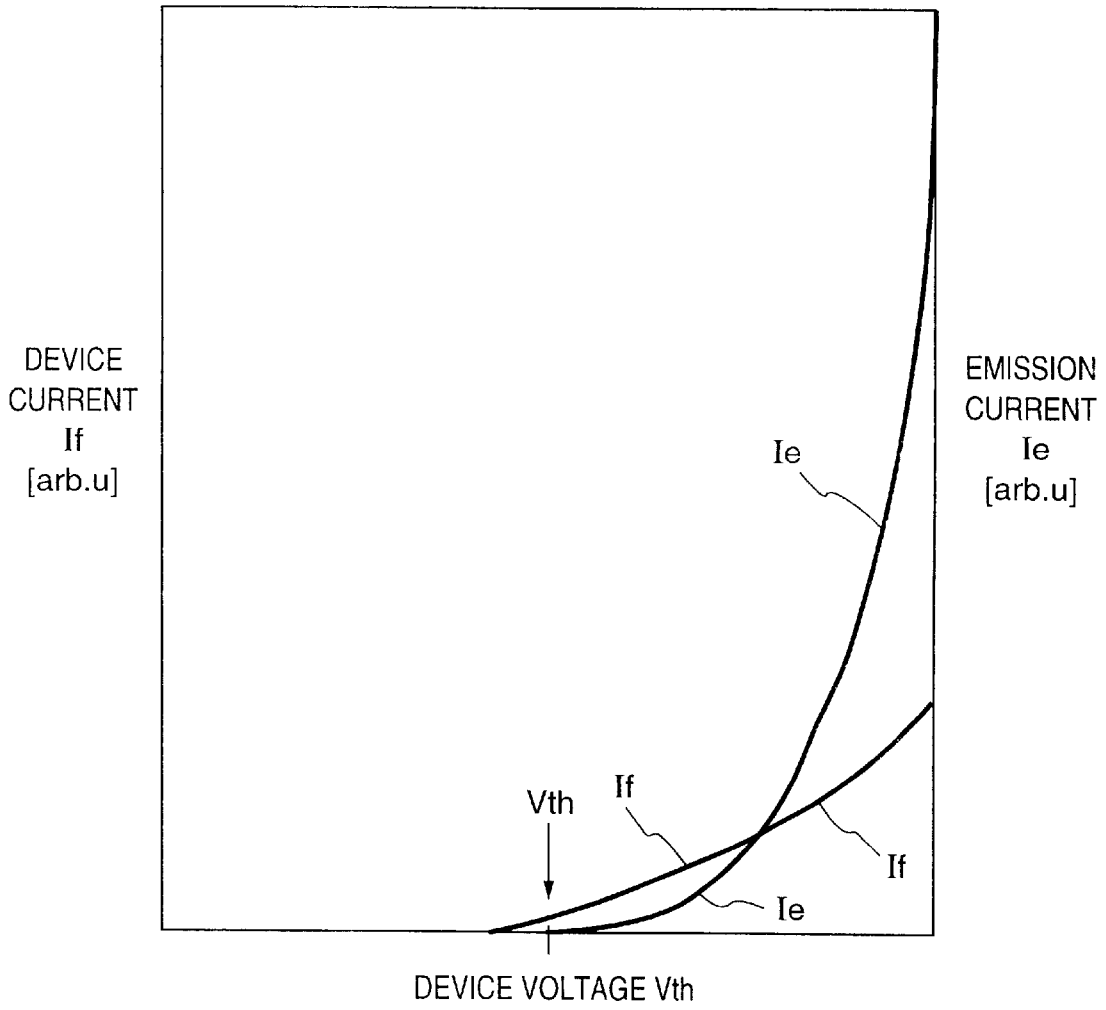
FIG. 15 is a graph showing typical characteristics of the surface-conduction emission type electron-emitting device used in the embodiment.

FIG. 15 shows a typical example of (emission current Ie) to (device voltage (i.e., voltage to be applied to the device) Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 15 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected.

That is, regarding the emission current Ie, the device has a nonlinear characteristic based on the clear threshold voltage Vth.

Second, the emission current Ie changes in dependence upon the device application voltage vf. Accordingly, the emission current Ie can be controlled by changing the device voltage Vf.

Third, the emission current Ie is output quickly in response to application of the device voltage Vf. Accordingly, an electrical charge amount of electrons to be emitted from the device can be controlled by changing period of application of the device voltage Vf.

The SCE type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

<Structure of Simple-Matrix Wired Multi Electron-Beam Source>

Next, the structure of a multi electron-beam source where a large number of the above SCE type electron-emitting devices are arranged with the simple-matrix wiring will be described below.

FIG. 17 is a plan view of the multi electron-beam source used in the display panel in FIG. 16. There are SCE type electron-emitting devices similar to those shown in FIGS. 9A and 9B on the substrate. These devices are arranged in a simple matrix with the row-direction wiring 1013 and the column-direction wiring 1014. At an intersection of the wirings 1013 and 1014, an insulating layer (not shown) is formed between the wires, to maintain electrical insulation.

FIG. 18 shows a cross-section cut out along the line A—A' in FIG. 17.

Note that this type multi electron-beam source is manufactured by forming the row- and column-direction wirings 1013 and 1014, the insulating layers (not shown) at wires intersections, the device electrodes and conductive thin films on the substrate, then supplying electricity to the respective devices via the row- and column-direction wirings 1013 and 1014, thus performing the forming processing and the activation processing.

<Arrangement (and Driving Method) of Driving Circuit>

Figure 19:
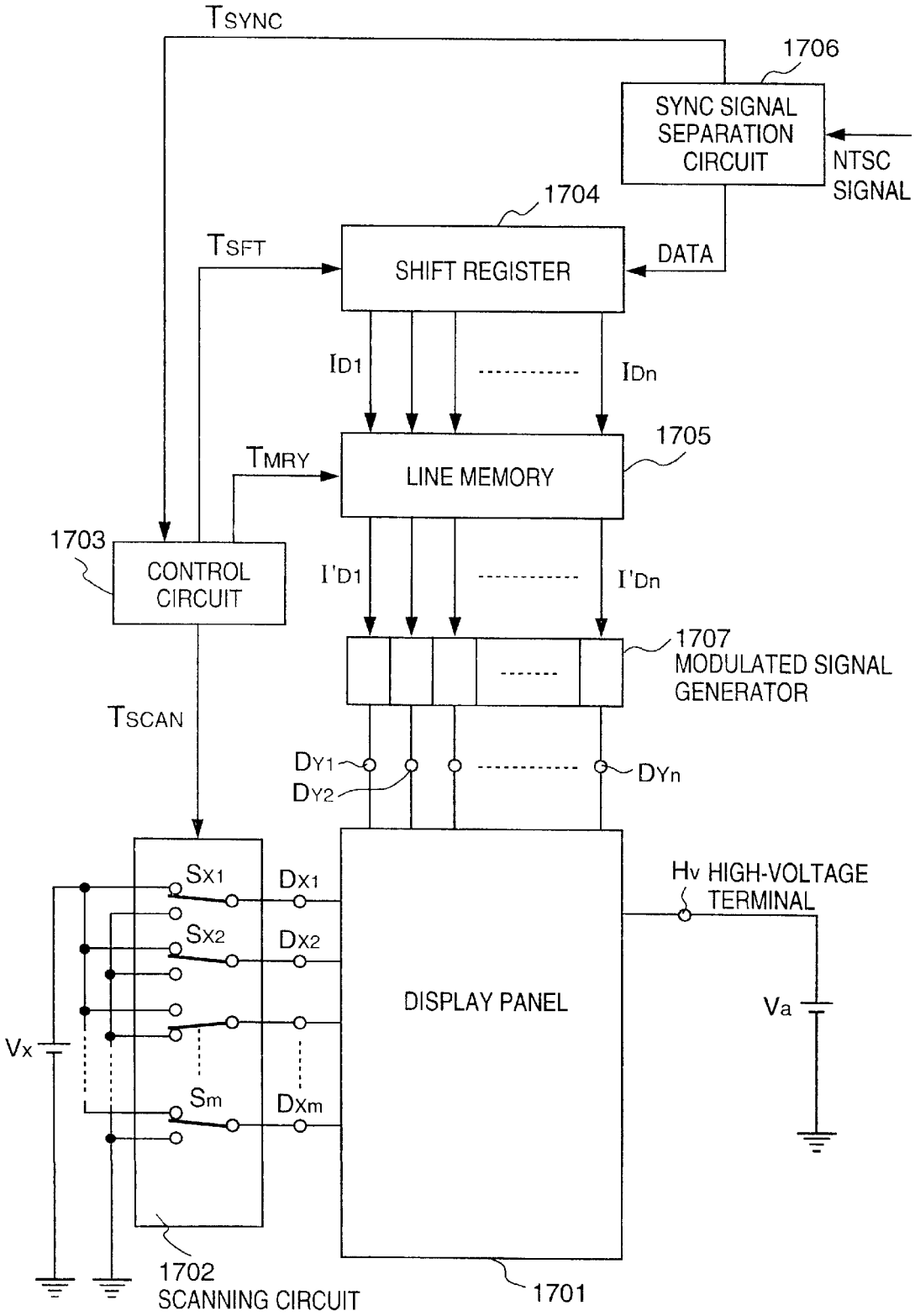
FIG. 19 is a block diagram showing the schematic arrangement of a driving circuit for the image display apparatus of the embodiment.
Figure 20:
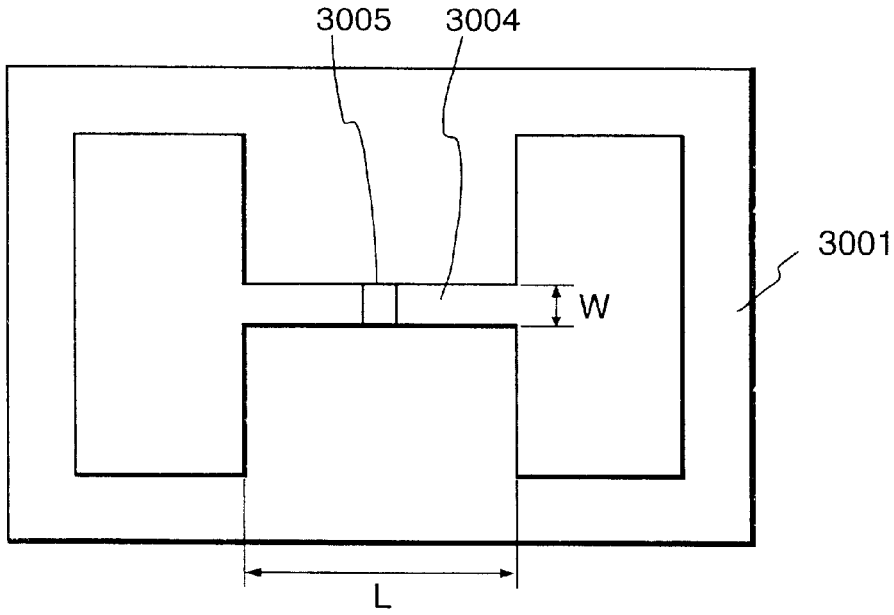
FIG. 20 is a view showing an example of the surface-conduction emission type electron-emitting device.
Figure 21:
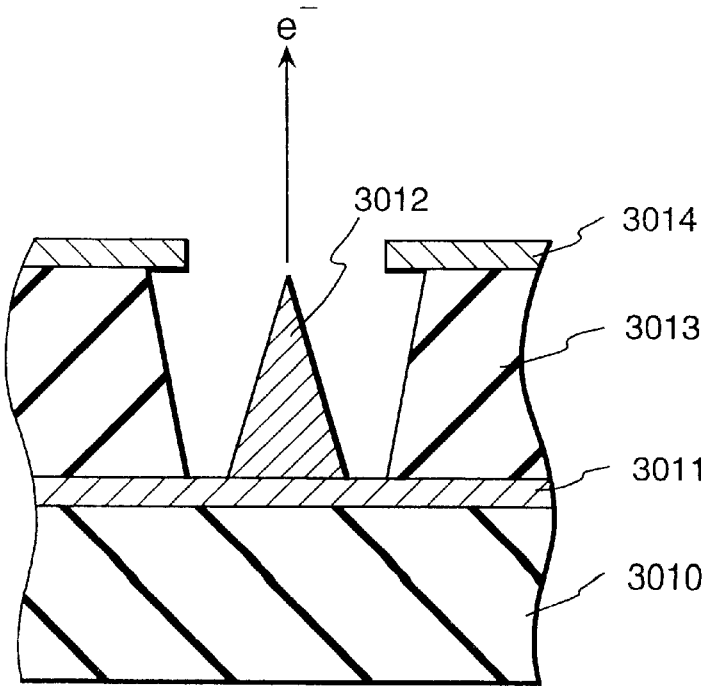
FIG. 21 is a view showing an example of an FE type device.
Figure 22:
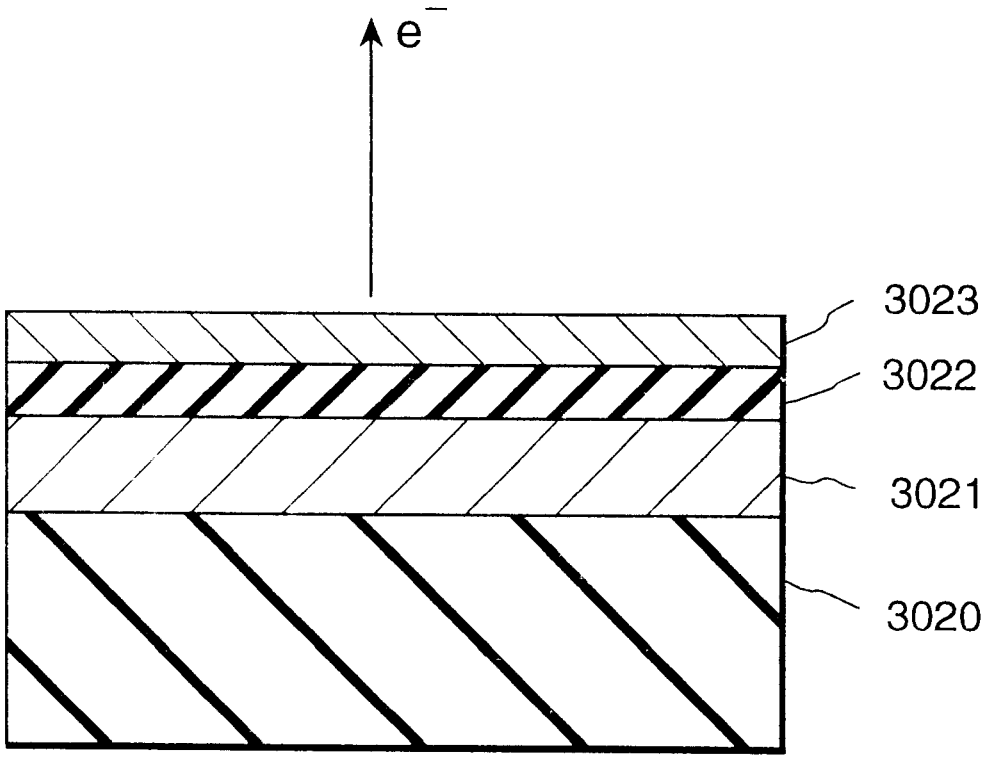
FIG. 22 is a view showing an example of an MIM type device.
Figure 23:
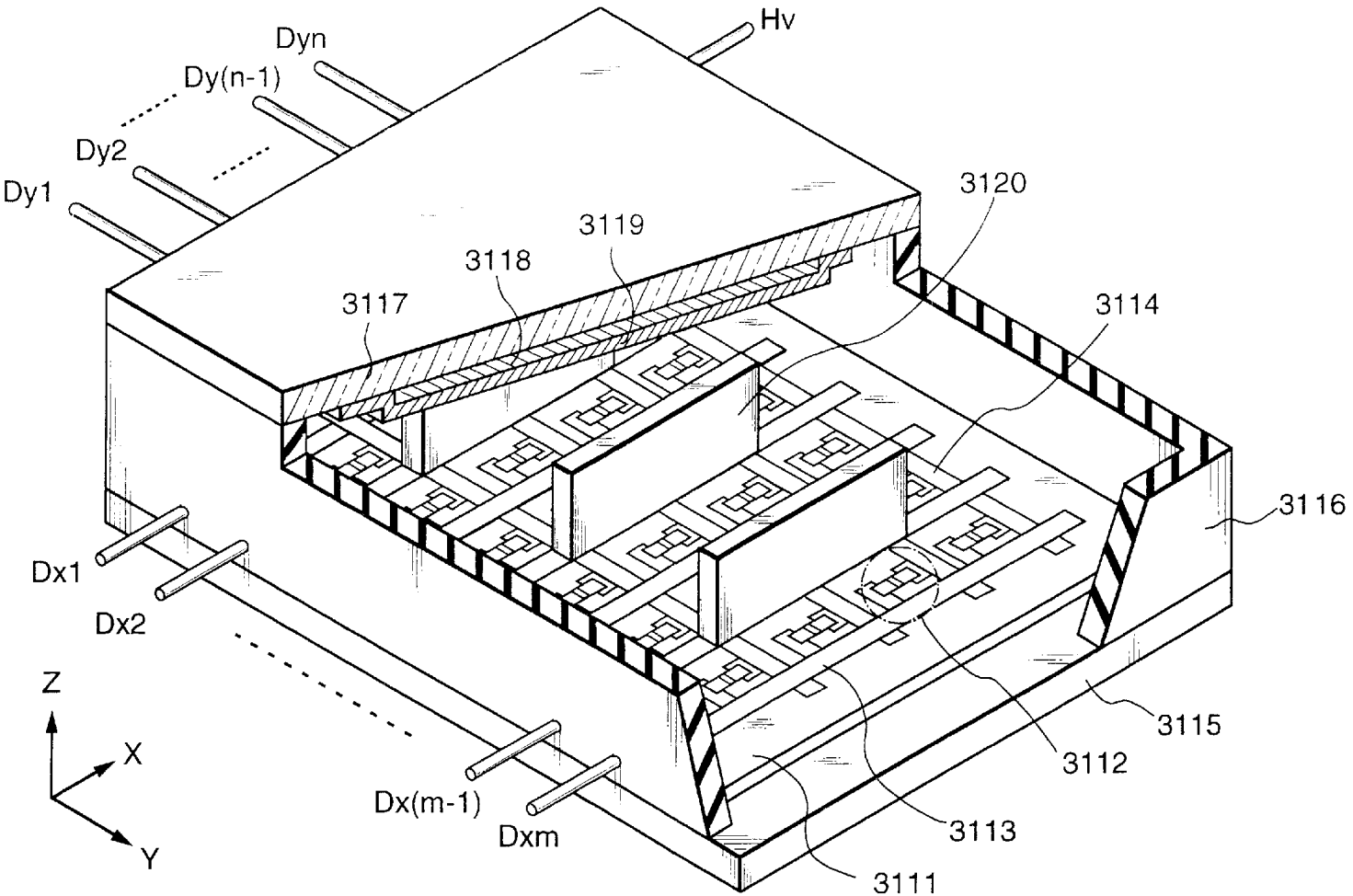
FIG. 23 is a partially cutaway perspective view of the display panel of the image display apparatus.

FIG. 19 is a block diagram showing the schematic arrangement of a driving circuit for performing television display on the basis of a television signal of the NTSC scheme.

Referring to FIG. 19, a display panel 1701 is manufactured and operates in the same manner described above. A scanning circuit 1702 scans display lines. A control circuit 1703 generates signals and the like to be input to the scanning circuit 1702. A shift register 1704 shifts data in units of lines. A line memory 1705 inputs 1-line data from the shift register 1704 to a modulated signal generator 1707. A sync signal separation circuit 1706 separates a sync signal from an NTSC signal.

The function of each component in FIG. 19 will be described in detail below.

The display panel 1701 is connected to an external electric circuit through terminals Dx1 to Dxm and Dy1 to Dyn and a high-voltage terminal Hv. Scanning signals for sequentially driving an electron source 1 in the display panel 1701, i.e., a group of electron-emitting devices 15 wired in a m×n matrix in units of lines (in units ofn devices) are applied to the terminals Dx1 to Dxm.

Modulated signals for controlling the electron beams output from the electron-emitting devices 15 corresponding to one line, which are selected by the above scanning signals, are applied to the terminals Dy1 to Dyn. For example, a DC voltage of 5 kV is applied from a DC voltage source Va to the high-voltage terminal Hv. This voltage is an accelerating voltage for giving energy enough to excite the fluorescent substances to the electron beams output from the electron-emitting devices 15.

The scanning circuit 1702 will be described next.

This circuit incorporates m switching elements (denoted by reference symbols S1 to Sm in FIG. 19). Each switching element serves to select either an output voltage from a DC voltage source Vx or 0 V (ground level) and is electrically connected to a corresponding one of the terminals Dox1 to Doxm of the display panel 1701. The switching elements S1 to Sm operate on the basis of a control signal Tscan output from the control circuit 1703. In practice, this circuit can be easily formed in combination with switching elements such as FETs.

The DC voltage source Vx is set on the basis of the characteristics of the electron-emitting device in FIG. 15 to output a constant voltage such that the driving voltage to be applied to a device which is not scanned is set to an electron emission threshold voltage Vth or lower.

The control circuit 1703 serves to match the operations of the respective components with each other to perform proper display on the basis of an externally input image signal. The control circuit 1703 generates control signals Tscan, Tsft, and Tmry for the respective components on the basis of a sync signal Tsync sent from the sync signal separation circuit 1706 to be described next.

The sync signal separation circuit 1706 is a circuit for separating a sync signal component and a luminance signal component from an externally input NTSC television signal. As is known well, this circuit can be easily formed by using a frequency separation (filter) circuit. The sync signal separated by the sync signal separation circuit 1706 is constituted by vertical and horizontal sync signals, as is known well. In this case, for the sake of descriptive convenience, the sync signal is shown as the signal Tsync. The luminance signal component of an image, which is separated from the television signal, is expressed as a signal DATA for the sake of descriptive convenience. This signal is input to the shift register 1704.

The shift register 1704 performs serial/parallel conversion of the signal DATA, which is serially input in a time-series manner, in units of lines of an image. The shift register 1704 operates on the basis of the control signal Tsft sent from the control circuit 1703. In other words, the control signal Tsft is a shift clock for the shift register 1704.

One-line data (corresponding to driving data for n electron-emitting devices) obtained by serial/parallel conversion is output as n signals ID1 to IDn from the shift register 1704.

The line memory 1705 is a memory for storing 1-line data for a required period of time. The line memory 1705 properly stores the contents of the signals ID1 to IDn in accordance with the control signal Tmry sent from the control circuit 1703. The stored contents are output as data I'D1 to I'Dn to be input to a modulated signal generator 1707.

The modulated signal generator 1707 is a signal source for performing proper driving/modulation with respect to each electron-emitting device 15 in accordance with each of the image data I'D1 to I'Dn. Output signals from the modulated signal generator 1707 are applied to the electron-emitting devices 15 in the display panel 1701 through the terminals Doy1 to Doyn.

The electron-emitting device according to the present invention has the following basic characteristics with respect to an emission current Ie, as described above with reference to FIG. 15. A clear threshold voltage Vth (8 V in the surface-conduction emission type electron-emitting device of the embodiment described later) is set for electron emission. Each device emits electrons only when a voltage equal to or higher than the threshold voltage Vth is applied.

In addition, the emission current Ie changes with a change in voltage equal to or higher than the electron emission threshold voltage Vth, as shown in FIG. 15. Obviously, when a pulse-like voltage is to be applied to this device, no electrons are emitted if the voltage is lower than the electron emission threshold voltage Vth. If, however, the voltage is equal to or higher than the electron emission threshold voltage Vth, the electron-emitting device emits an electron beam. In this case, the intensity of the output electron beam can be controlled by changing a peak value Vm of the pulse. In addition, the total amount of electron beam charges output from the device can be controlled by changing a width Pw of the pulse.

As a scheme of modulating an output from each electron-emitting device in accordance with an input signal, therefore, a voltage modulation scheme, a pulse width modulation scheme, or the like can be used. In executing the voltage modulation scheme, a voltage modulation circuit for generating a voltage pulse with a constant length and modulating the peak value of the pulse in accordance with input data can be used as the modulated signal generator 1707. In executing the pulse width modulation scheme, a pulse width modulation circuit for generating a voltage pulse with a constant peak value and modulating the width of the voltage pulse in accordance with input data can be used as the modulated signal generator 1707.

The shift register 1704 and the line memory 1705 may be of the digital signal type or the analog signal type. That is, it suffices if an image signal is serial/parallel-converted and stored at predetermined speeds.

When the above components are of the digital signal type, the output signal DATA from the sync signal separation circuit 1706 must be converted into a digital signal. For this purpose, an A/D converter may be connected to the output terminal of the sync signal separation circuit 1706. Slightly different circuits are used for the modulated signal generator depending on whether the line memory 1705 outputs a digital or analog signal. More specifically, in the case of the voltage modulation scheme using a digital signal, for example, a D/A conversion circuit is used as the modulated signal generator 1707, and an amplification circuit and the like are added thereto, as needed. In the case of the pulse width modulation scheme, for example, a circuit constituted by a combination of a high-speed oscillator, a counter for counting the wave number of the signal output from the oscillator, and a comparator for comparing the output value from the counter with the output value from the memory is used as the modulated signal generator 1707. This circuit may include, as needed, an amplifier for amplifying the voltage of the pulse-width-modulated signal output from the comparator to the driving voltage for the electron-emitting device.

In the case of the voltage modulation scheme using an analog signal, for example, an amplification circuit using an operational amplifier and the like may be used as the modulated signal generator 1707, and a shift level circuit and the like may be added thereto, as needed. In the case of the pulse width modulation scheme, for example, a voltage-controlled oscillator (VCO) can be used, and an amplifier for amplifying an output from the oscillator to the driving voltage for the electron-emitting device can be added thereto, as needed.

In the image display apparatus of this embodiment which can have one of the above arrangements, when voltages are applied to the respective electron-emitting devices through the outer terminals Dx1 to Dxm and Dy1 to Dyn, electrons are emitted. A high voltage is applied to the metal back 1019 or the transparent electrode (not shown) through the high-voltage terminal Hv to accelerate the electron beams. The accelerated electrons collide with the fluorescent film 1018 to cause it to emit light, thereby forming an image.

The above arrangement of the image display apparatus is an example of an image forming apparatus to which the present invention can be applied. Various changes and modifications of this arrangement can be made within the spirit and scope of the present invention. Although a signal based on the NTSC scheme is used as an input signal, the input signal is not limited to this. For example, the PAL scheme and the SECAM scheme can be used. In addition, a TV signal (high-definition TV such as MUSE) scheme using a larger number of scanning lines than these schemes can be used.

<General Description of Insulating Spacer>

This embodiment concerns a flat image forming apparatus using insulating spacers. Referring to FIG. 16 showing the schematic structure of the image forming apparatus, this apparatus is a display apparatus having a structure in which the substrate 1011 with a plurality of cold cathode devices 1012 formed thereon faces the transparent face plate 1017 with the fluorescent substances 1018 as a light-emitting material formed thereon via the spacers 1020. This image forming apparatus is characterized by an electrode made of a low-resistance film on the abutment surface of each spacer against the electron source substrate and the side surface of the spacer within a predetermined distance from the abutment surface.

In the image forming apparatus of this embodiment, one side of the spacer 1020 is electrically connected to wiring on the substrate 1011 on which the cold cathode devices are formed. The other side is connected to an acceleration electrode (metal back 1019) for causing electrons emitted by the cold cathode devices to collide with the light-emitting material (fluorescent film 1018) at high energy. As a spacer material, an insulating material is used. This material operates to produce positive charges on the surface of the spacer and draw electrons near the spacer toward the spacer upon driving the cold cathode devices 1012.

Figure 5A:
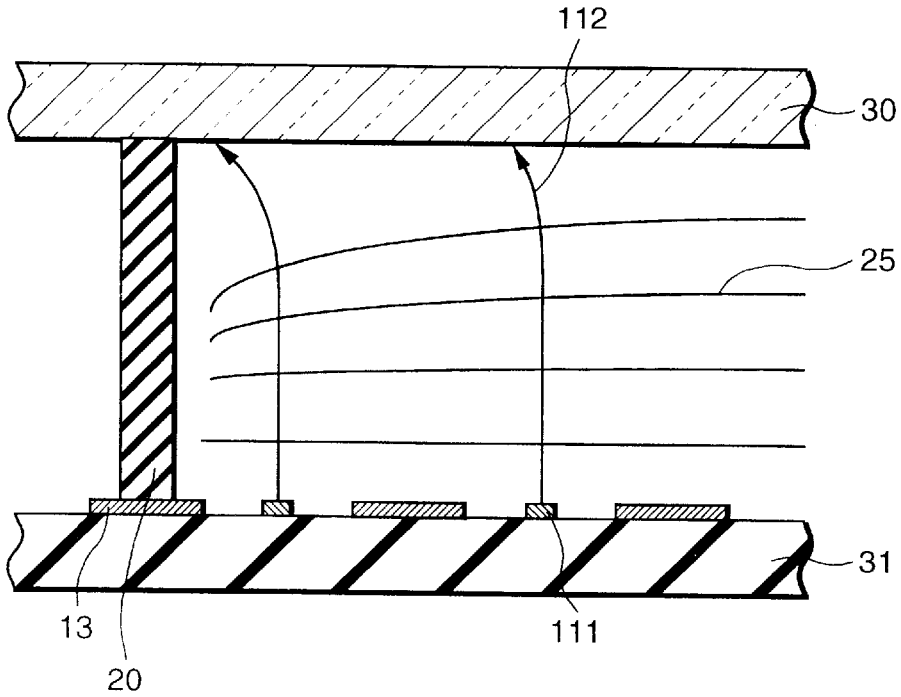
FIGS. 5A and 5B are views for explaining the results of an improvement in electron emission orbit in the embodiment.
Figure 5B:
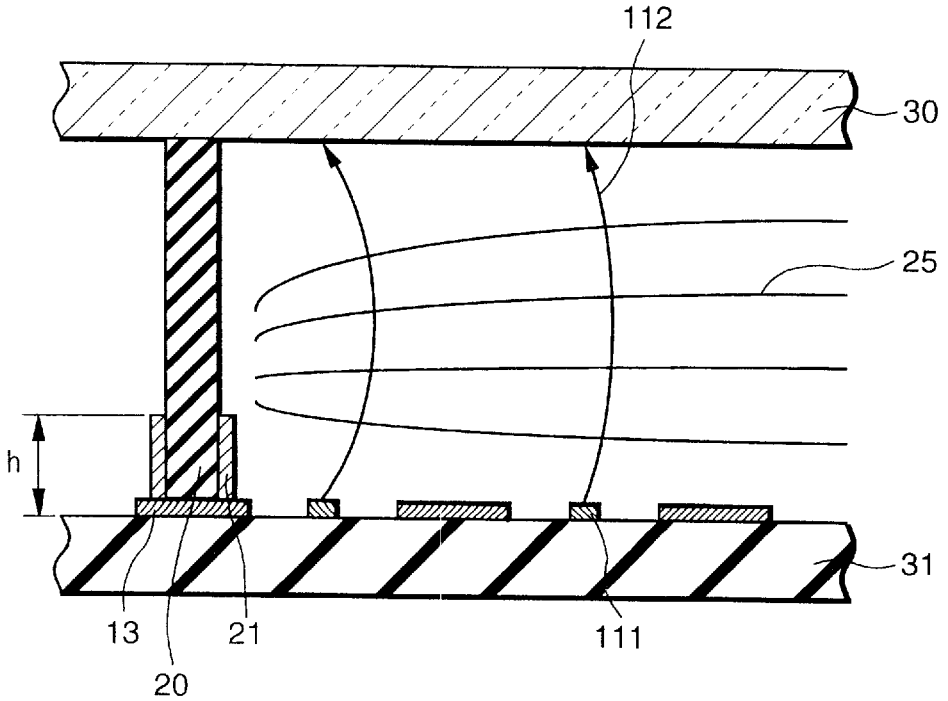

This state will be explained with reference to FIGS. 5A and 5B. FIGS. 5A and 5B are schematic cross-sectional views cut out along the A–A' in FIG. 16. Numeral 31 denotes a rear plate including an electron source substrate; 30, a face plate including fluorescent substances and a metal back; 20, a spacer; 21, an electrode (intermediate layer) made of a low-resistance film; 13, wiring; 25, an equipotential line; 111, a device; and 112, an electron beam orbit. As shown in FIG. 5A, the insulating spacer 20 may be charged when some of electrons emitted near the spacer strike the spacer or ions produced by the action of emitted electrons attach to the spacer. Further, some of electrons which have reached the face plate may be reflected and scattered, and some of the scattered electrons may strike the spacer to charge the spacer. Upon the charge-up of the spacer, the space near the spacer changes to have an electric field indicated by the equipotential lines 25. Electrons emitted by the cold cathode devices are changed in orbit, and reach positions near the spacer on the fluorescent substances or are completely drawn by the spacer. This charge-up of the spacer or the positional shift caused by the charge-up of the spacer is saturated after a while upon the start of driving. The charges of the spacer are eliminated very slowly, so they are eliminated at a scanning interval of, e.g., an NTSC image, and the electric field of the space is kept unchanged.

As shown in FIG. 5B, to control the orbit of an electron beam by the steady charge-up (or the electric field of the space generated by the charge-up), and cause the electron beam to reach a proper position on the fluorescent substance, the electrode (to be also referred to as an intermediate layer hereinafter) 21 made of a low-resistance film is formed on the abutment surface of the spacer against the rear plate 31 and the side surface of the spacer in contact with the rear plate 31 to change the electric field of the spacer, as indicated by the equipotential lines 25. Accordingly, electrons temporarily move near the rear plate in the direction to move away from the spacer. As the electrons come closer to the spacer, the electrons travel in the direction to move close to the spacer. By appropriately selecting a height h of this electrode, the electrons can be caused to reach proper positions on the fluorescent substances.

Figure 6:
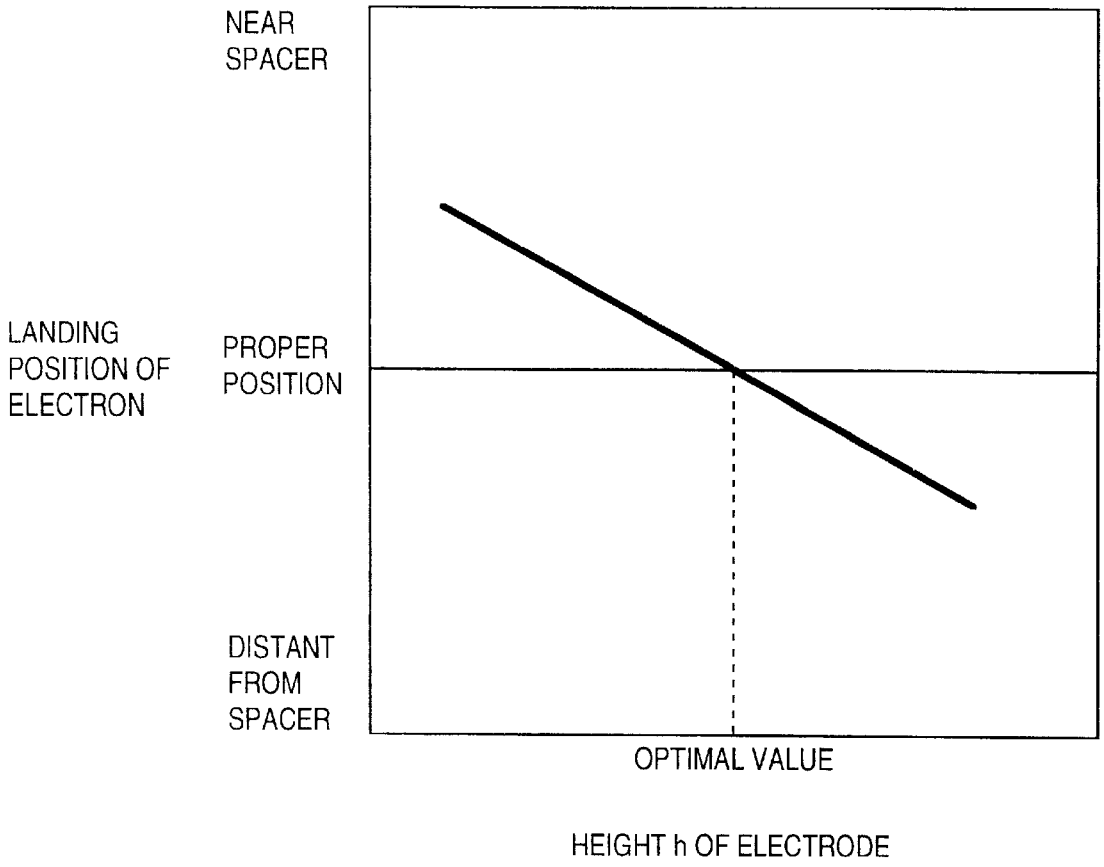
FIG. 6 is a graph showing the characteristics of the landing position of an electron in the embodiment.

When the thickness of the panel is 0.5 to 10 mn, and at least the height h of the electrode (intermediate layer) 21 is 1/20 or more to 1/4 or less the thickness of the panel, the height h of the intermediate layer 21 and the landing position of the electron have an almost linear relationship, as shown in FIG. 6. Several conditions were experimentally set to estimate a proper height h.

Figure 2:
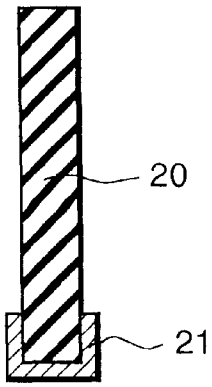
FIG. 2 is a cross-sectional view of the structure of the spacer in the embodiment.

The low-resistance electrode 21 of the spacer in this embodiment may extend to the abutment surface of the spacer against the electron source substrate, as shown in FIG. 2. In this case, the conductive state between the electron source substrate and the low-resistance electrode on the side surface of the spacer in contact with the electron source substrate is preferably improved.

Figure 3:
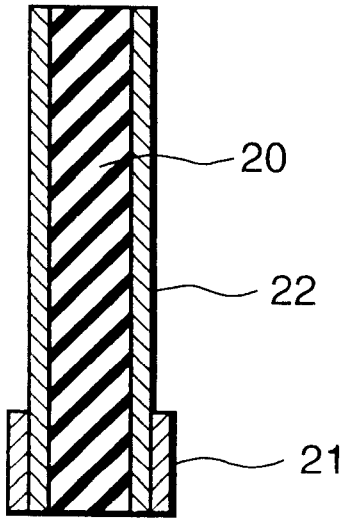
FIG. 3 is a cross-sectional view of another structure of the spacer in the embodiment.
Figure 4:
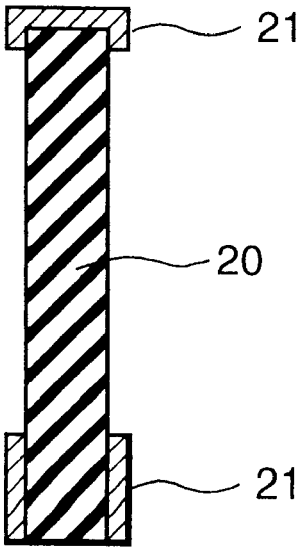
FIG. 4 is a cross-sectional view of still another structure of the spacer in the embodiment.

If the spacer of the present invention has insulating properties, an insulating film 22 made of polyimide, AlN, BN, SiN, high-resistance silicon, or the like may be formed on the insulating member 20, as shown in FIG. 3. The secondary electron-emitting efficiency of the insulating film is preferably low.

Another electrode for setting the spacer at the same potential as that of the face plate may be formed on the abutment surface of the spacer against the face plate and the side surface of the spacer in contact with the face plate. In this case, discharge at a small gap between the face plate and the spacer can be suppressed.

The present invention will be explained in more detail below by referring to embodiments.

In the following embodiments, a multi electron-beam source is prepared such that N×M (N=3,072, M=1,024) SCE type electron-emitting devices each having an electron-emitting portion on a conductive fine particle film between electrodes are wired in a matrix by M row-direction wirings andN column-direction wirings (see FIGS. 16 and 17).

An appropriate number of spacers are arranged to obtain the atmospheric pressure resistance of the image forming apparatus.

First Embodiment

Figure 7:
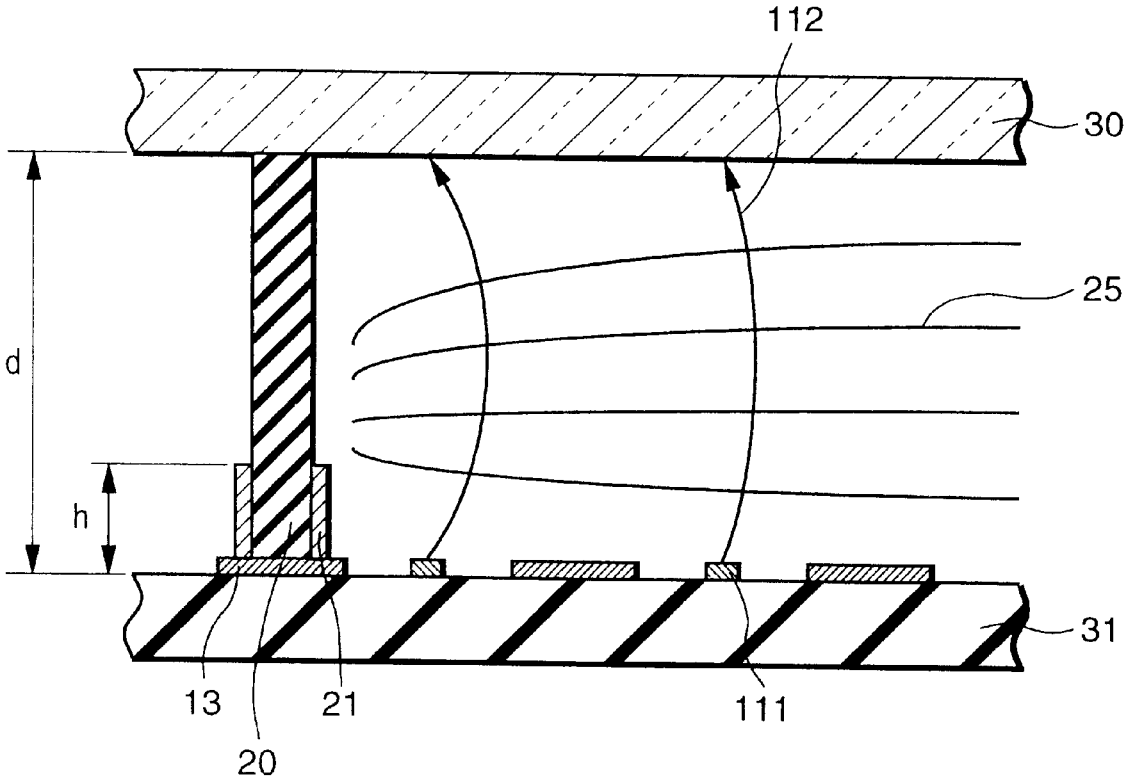
FIG. 7 is a view showing the structure of the spacer and the travel orbit of an electron in the embodiment.

The first embodiment will be described with reference to FIG. 7. FIG. 7 is a schematic cross-sectional view cut out along the line A–A' in FIG. 16 showing the display apparatus using the spacer of the present invention (first embodiment). Referring to FIG. 7, numeral 31 denotes a rear plate including an electron source substrate; 30, a face plate including fluorescent substances and a metal back; 20, an insulating spacer made of a soda-lime glass; 21, an electrode (intermediate layer) made of a low-resistance film; 13, wiring; 25, an equipotential line; 111, a device; and 112, an electron beam orbit.

A distance (to be referred to as a panel thickness hereinafter) d between the inner surface of the face plate 30 and the inner surface of the rear plate 31 was set to 1 mm, and a height h of the. electrode 21 was set to 200 μm. In this case, electrons from a device column (to be referred to as the nearest line hereinafter) spaced apart from the spacer by about 250 μm reached proper positions on the fluorescent substances. This indicates that the apparatus is improved, compared to the case not using the intermediate layer 21 wherein electrons from the nearest line reached positions shifting from proper positions on the fluorescent substances toward the spacer by about 120 μm. At this time, the orbits of electrons emitted by devices on a device line (to be referred to as the second nearest line hereinafter) spaced apart from the spacer by about 950 μm, and on subsequent devices were not influenced. As a result, an image free from distortion and fluctuation could be obtained.

Second Embodiment

The second embodiment is different from the first embodiment in that the panel thickness d is set to 2 mm, and the height h of an intermediate layer 21 was to 350 μm. In this case, electrons from the nearest line reached proper positions, and electrons from the second nearest line shifted toward the spacer by about 150 μm on the fluorescent substances. This indicates that the apparatus is improved, compared to the case not using the intermediate layer 21 wherein electrons from the nearest line were drawn to the spacer so as to make a beam almost invisible, and electrons from the second nearest line shifted toward the spacer by about 200 μm on the fluorescent substances. At this time, electrons from device lines subsequent to the second nearest line were not influenced. Consequently, an image free from distortion in comparison with the case not using the intermediate layer 21 could be obtained. Of course, no fluctuation was observed.

Third Embodiment

The third embodiment is different from the first embodiment by forming an AlN film on the surface of the spacer.

The sheet resistance of the AlN film was $10^{13}$ Ω/sq. Also in this case, the same effects as those in the first embodiment were confirmed.

As described above, according to the above embodiments, electrons can be caused to reach proper positions by the steady charge-up of the insulating spacer and the steady electric field generated by the electrode of the spacer on the electron source substrate side, and an image free from distortion and fluctuation can be displayed (or distortion can be reduced).

Fourth Embodiment

Figure 24:
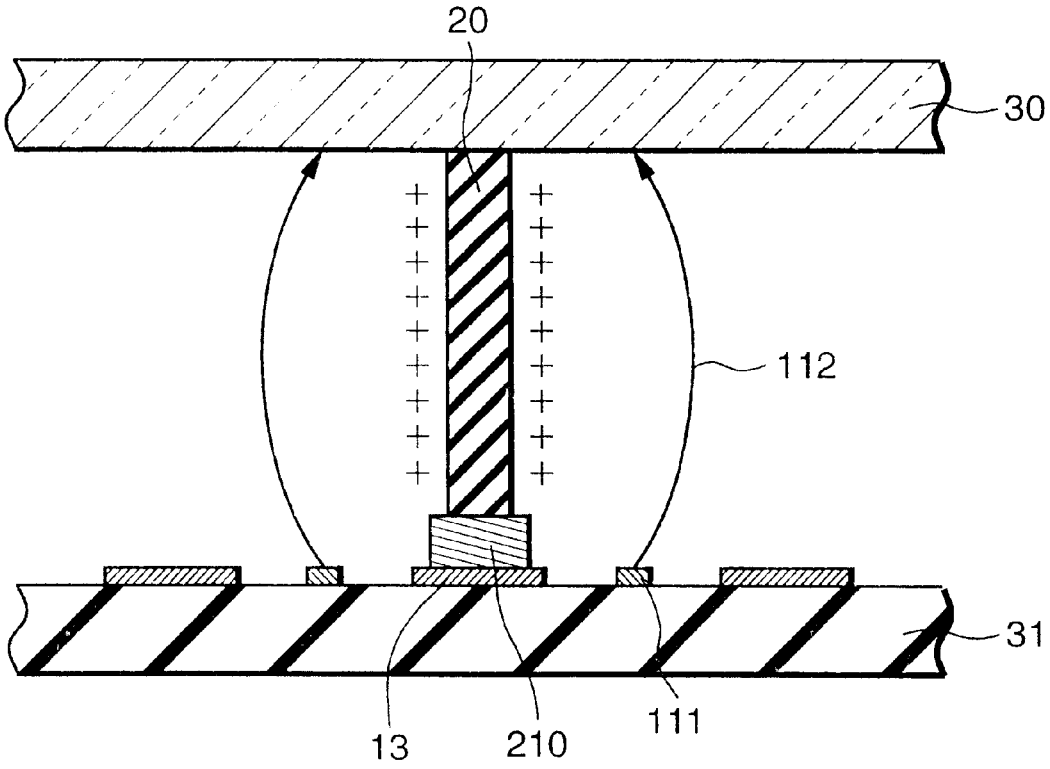
FIG. 24 is a view showing the structure of the spacer and the traveling orbit of an electron in the embodiment.

The fourth embodiment exemplifies the case applying a block-shaped low-resistance member as an intermediate layer member. FIG. 24 is a cross-sectional view of a spacer portion in the fourth embodiment.

Numeral 31 denotes a rear plate including an electron source substrate; 30, a face plate including fluorescent substances and a metal back; 20, a spacer; 210, a block-shaped low-resistance member; 13, wiring; 111, a device; and 112, an electron beam orbit. The distance (to be referred to as a panel thickness hereinafter) d between the inner surface of the face plate 30 and the inner surface of the rear plate 31 was set to 2.3 mm, and the height h of the low-resistance member 210 was to 350 μm. In this case, electrons from a device column (to be referred to as the nearest line hereinafter) spaced apart from the spacer by about 300 μM were made by the block-shaped low-resistance member to follow an orbit in the direction to move away from the spacer, and then drawn to the spacer by positive charges on the spacer. As a result, the electrons reached proper positions on the fluorescent substances. At this time, the orbits of electrons emitted by devices on a device line (to be referred to as the second nearest line hereinafter) spaced apart from the spacer by about 1,100 μm, and on subsequent devices were not influenced. Similar to the above embodiments, an image free from distortion and fluctuation could be obtained.

In the fourth embodiment, as the block-like low-resistance member, a 350×300-μm aluminum member was used. However, the low-resistance member can be made of metals such as Ni, Cr, Au, Mo, W, Pt, Ti, Al, Cu, and Pd, and alloys of these metals. In the fourth embodiment, the spacer was made of alumina.

Fifth Embodiment

<Concave Low-Resistance Portion>

Figure 25:
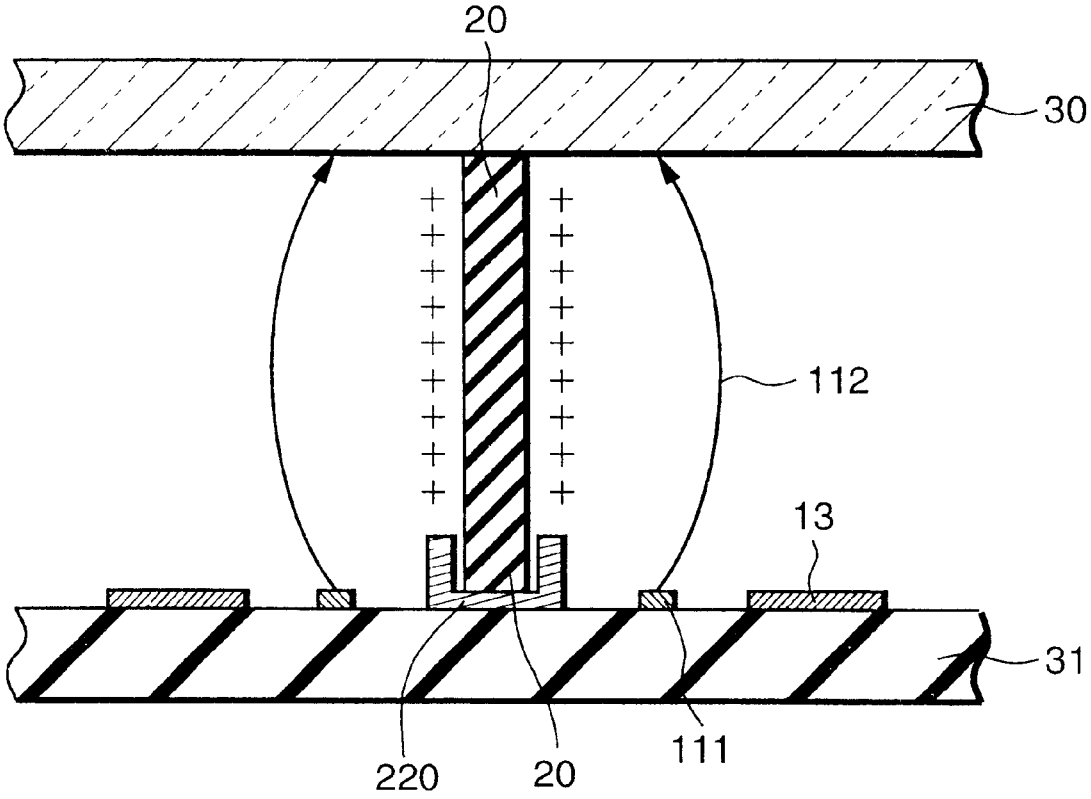
FIG. 25 is a view showing the structure of another spacer and the traveling orbit of an electron in the embodiment.

FIG. 25 is a view for explaining the fifth embodiment of the present invention using a concave low-resistance member.

Numeral 31 denotes a rear plate including an electron source substrate; 30, a face plate including fluorescent substances and a metal back; 20, a spacer; 220, a concave low-resistance member; 13, wiring; 111, a device; and 112, an electron beam orbit. The distance (to be referred to as a panel thickness hereinafter) d between the inner surface of the face plate 30 and the inner surface of the rear plate 31 was set to 1.6 mm, and the height h of the concave low-resistance member 220 was to 150 μm. In this case, electrons from a device column (to be referred to as the nearest line hereinafter) spaced apart from the spacer by about 200 μm reached proper positions on the fluorescent substances. At this time, the orbits of electrons emitted by devices on a device line (to be referred to as the second nearest line hereinafter) spaced apart from the spacer by about 800 μm, and on subsequent devices were not influenced. Similar to the above embodiments, an image free from distortion and fluctuation could be obtained.

In the fifth embodiment, the concave low-resistance member was prepared by applying a conductive frit to wiring in a 330×150-μm shape by a dispenser, and tall portions of this member were formed on the two sides of the spacer. The conductive frit was fabricated by mixing a conductive filler or a conductive material such as metal in a frit glass.

Sixth Embodiment

<Flat FE Type Device>

The sixth embodiment is directed to a flat field emission (FE) type electron-emitting device used as the electron-emitting device of the present invention.

Figure 26:
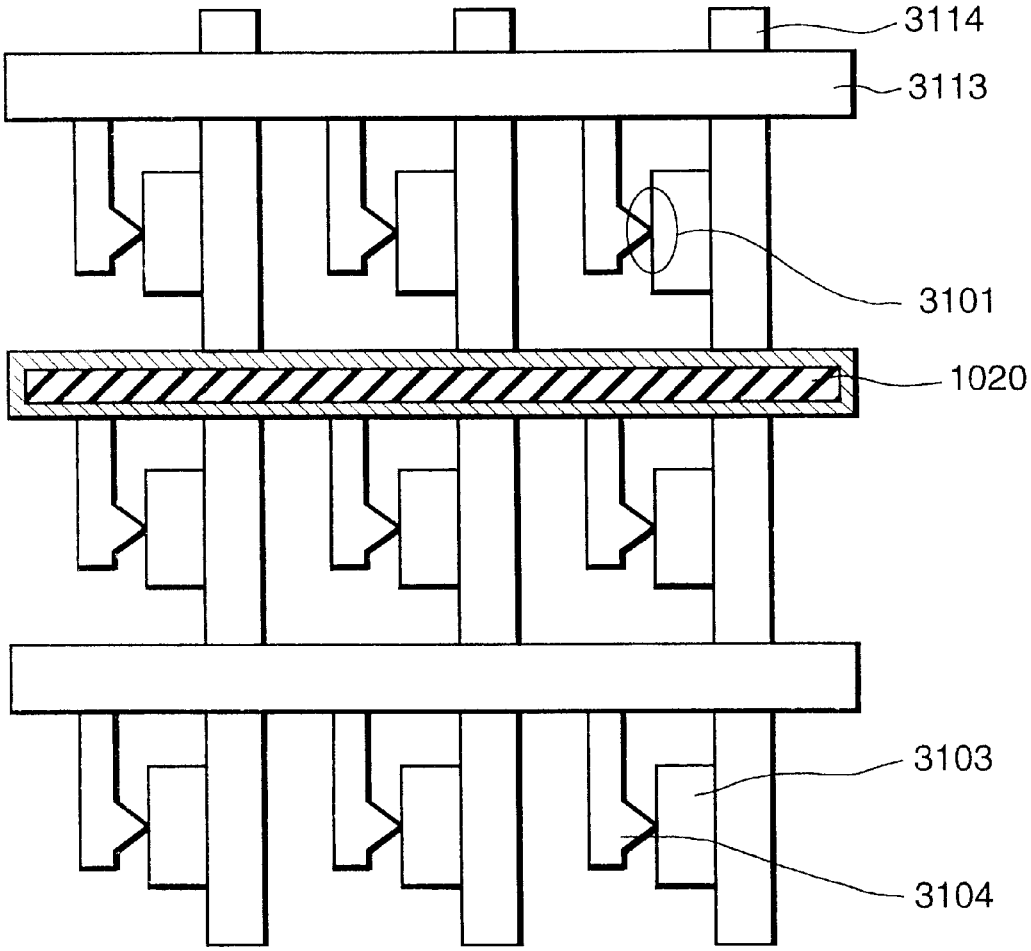
FIG. 26 is a plan view of the substrate of the multi electron-beam source in the embodiment.

FIG. 26 is a plan view of the flat FE type electron-emitting device. Numeral 3101 denotes an electron-emitting portion; 3102 and 3103, a pair of device electrodes for applying a potential to the electron-emitting portion 3101; 3113, row-direction wiring; 3114, column-direction wiring; and 1020, a spacer.

In electron emission, a voltage is applied across the device electrodes 3102 and 3103 to cause a sharp distal end in the electron-emitting portion 3101 to emit an electron. The electron is drawn by an accelerating voltage (not shown) facing the electron source to collide with a fluorescent substance (not shown), and causes the fluorescent substance to emit light. In the sixth embodiment, an image apparatus was formed by arranging spacers by the same method as in the first embodiment, and driven similarly to the first embodiment to obtain a high-quality image in which a beam shift was suppressed even near the spacer.

As has been described above, according to the present invention, the shift amount of the actual irradiation position of an electron on the front substrate having the image forming member from a position on which the electron is wanted to be irradiated can be decreased. Accordingly, an image free from distortion and fluctuation can be formed.

As many apparently widely different embodiments of the present invention can be made without departing from the spirit and scope thereof, it is to be understood that the invention is not limited to the specific embodiments thereof except as defined in the append claims.

What is claimed is:

1. An image forming apparatus comprising:

a rear substrate having an electron-emitting device;

a front substrate having an image forming member; and a support member for maintaining an interval between said rear substrate and said front substrate, wherein said support member has insulating properties for maintaining a charge-up amount of said support member in a substantially stable state in driving said electron-emitting device, and comprises an electrode for applying a deflection force in a direction away from said support member to an electron emitted by said electron-emitting device, wherein said electrode is arranged on a portion of said support member near said rear substrate and is not arranged past a predetermined position on said support member, and wherein when a distance between said rear substrate and said front substrate is 0.5 mm to 10 mm, a size of a pixel formed on said front substrate upon reception of an emitted electron is 100 μm to 1 mm, and an accelerating voltage for accelerating an electron emitted by said electron-emitting device toward said image forming member is 1 to 15 kV, and the distance between said rear substrate and the predetermined position is not more than ¼ of the distance between said rear substrate and said front substrate.

2. The apparatus according to claim 1, wherein said electrode of said support member relaxes deflection of an electron emitted by said electron-emitting device toward said support member owing to charge-up of said support member.

3. The apparatus according to claim 1, wherein said electrode is connected to wiring arranged on said rear substrate.

4. The apparatus according to claim 1, wherein said electrode is arranged to abut against said rear substrate.

5. The apparatus according to claim 4, wherein said electrode is also arranged on an abutment surface of said support member against said rear substrate.

6. The apparatus according to claim 1, wherein said support member is given a characteristic of maintaining a state in which a charge-up amount is substantially saturated, by a film formed on a surface of said support member.

7. The apparatus according to claim 1, wherein said support member has a sheet resistance of not less than $10^{12}$ Ω/sq.

8. The apparatus according to claim 1, further comprising a plurality of electron-emitting devices.

9. The apparatus according to claim 1, further comprising a plurality of electron-emitting devices arranged substantially linearly, and wherein said electrode causes deflection so that an interval between irradiation points, on said image forming member, of electrons emitted by electron-emitting devices adjacent to each other via said support member is almost equal to an interval between irradiation points, on said image forming member, of electrons emitted by electron-emitting devices adjacent to each other without mediacy of said support member.

10. The apparatus according to claim 1, wherein the distance between said rear substrate and the predetermined position is not less that 1/20 of the distance between said rear substrate and the front substrate.

11. The apparatus according to claim 1, wherein the distance between said rear substrate and the predetermined position is not less than 1/20 of the distance between said rear substrate and the front substrate.

12. An image forming apparatus comprising:

a rear substrate having an electron-emitting device;

a front substrate having an image forming member; and a support member for maintaining an interval between said rear substrate and said front substrate, wherein said support member maintains a state in which a charge-up amount is substantially constant, and comprises an electrode for applying a deflection force in a direction away from said support member to an electron emitted by said electron-emitting device, wherein said electrode is arranged on a portion of said support member near said rear substrate and is not arranged past a predetermined position on said support member, and wherein when a distance between said rear substrate and said front substrate is 0.5 mm to 10 mm, a size of a pixel formed on said front substrate upon reception of an emitted electrode is 100 μm to 1 mm, and an accelerating voltage for accelerating an electron emitted by said electron-emitting device toward said image forming member is 1 to 15 kV, and the distance between said rear substrate and the predetermined position is not more than ¼ of the distance between said rear substrate and said front substrate.

13. The apparatus according to claim 2, wherein said electrode of said support member relaxes deflection of an electron emitted by said electron-emitting device toward said support member owing to charge-up of said support member.

14. The apparatus according to claim 12, wherein said electrode is connected to wiring arranged on said rear substrate.

15. The apparatus according to claim 12, wherein said electrode is arranged to abut against said rear substrate.

16. The apparatus according to claim 15, wherein said electrode is also arranged on an abutment surface of said support member against said rear substrate.

17. The apparatus according to claim 12, wherein said support member is given a characteristic of maintaining a state in which a charge-up amount is substantially constant, by a film formed on a surface of said support member.

18. The apparatus according to claim 12, wherein said support member has a sheet resistance of not less than $10^{12}$ Ω/sq.

19. The apparatus according to claim 12, further comprising a plurality of electron-emitting devices.

20. The apparatus according to claim 12, further comprising a plurality of electron-emitting devices arranged substantially linearly, and wherein said electrode causes deflection so that an interval between irradiation points, on said image forming member, of electrons emitted by electron-emitting devices adjacent to each other via said support member is almost equal to an interval between irradiation points, on said image forming member, of electrons emitted by electron-emitting devices adjacent to each other without mediacy of said support member.

21. An image forming apparatus comprising:

a rear substrate having an electron-emitting device;

a front substrate having an image forming member; and a support member for maintaining an interval between said rear substrate and said front substrate, wherein said support member has insulating properties for maintaining a charge-up amount of said support member in a substantially stable state in driving said electron-emitting device, and comprises an electrode for applying a deflection force in a direction away from said support member to an electron emitted by said electron-emitting device, and wherein said support member is given a characteristic of maintaining a state in which a charge-up amount is substantially saturated, by a film formed on a surface of said support member.

22. The apparatus according to claim 21, wherein said electrode of said support member relaxes deflection of an electron emitted by said electron-emitting device toward said support member owing to charge-up of said support member.

23. The apparatus according to claim 21, wherein said electrode is connected to wiring arranged on said rear substrate.

24. The apparatus according to claim 21, wherein said electrode is arranged on a portion of said support member near said rear substrate and is not arranged past a predetermined position on said support member.

25. The apparatus according to claim 21, wherein said electrode is arranged to abut against said rear substrate.

26. The apparatus according to claim 25, wherein said electrode is also arranged on an abutment surface of said support member against said rear substrate.

27. The apparatus according to claim 21, wherein said support member has a sheet resistance of not less than $10^{12}$ Ω/sq.

28. The apparatus according to claim 21, further comprising a plurality of electron-emitting devices.

29. The apparatus according to claim 21, further comprising a plurality of electron-emitting devices arranged substantially linearly, and wherein said electrode causes deflection so that an interval between irradiation points, on said image forming member, of electrons emitted by electron-emitting devices adjacent to each other via said support member is almost equal to an interval between irradiation points, on said image forming member, of electrons emitted by electron-emitting devices adjacent to each other without mediacy of said support member.

30. An image forming apparatus comprising:

a rear substrate having an electron-emitting device;

a front substrate having an image forming member; and a support member for maintaining an interval between said rear substrate and said front substrate, wherein said support member maintains a state in which a charge-up amount is substantially constant, and comprises an electrode means for applying a deflection force in a direction away from said support member to an electron emitted by said electron-emitting device, wherein the electrode means includes an electrode; and wherein said support member is given a characteristic of maintaining a state in which a charge-up amount is substantially constant, by a film formed on a surface of said support member.

31. The apparatus according to claim 30, wherein said electrode means for applying a deflection force in a direction away from said support member to an electron emitted by said electron-emitting device relaxes deflection of an emitted by said electron-emitting device toward said support member owing to charge-up of said support member.

32. The apparatus according to claim 30, wherein said electrode is connected to wiring arranged on said rear substrate.

33. The apparatus according to claim 30, wherein said electrode is arranged on a portion of said support member near said rear substrate and is not arranged past a predetermined position on said support member.

34. The apparatus according to claim 30, wherein said electrode is arranged to abut against said rear substrate.

35. The apparatus according to claim 34, wherein said electrode is also arranged on an abutment surface of said support member against said rear substrate.

36. The apparatus according to claim 30, wherein said support member has a sheet resistance of not less than $10^{12}$ Ω/sq.

37. The apparatus according to claim 30, further comprising a plurality of electron-emitting devices.

38. The apparatus according to claim 30, further comprising a plurality of electron-emitting devices arranged substantially linearly, and wherein said electrode causes deflection so that an interval between irradiation points, on said image forming member, of electrons emitted by electron-emitting devices adjacent to each other via said support member is almost equal to an interval between irradiation points, on said image forming member, of electrons emitted by electron-emitting devices adjacent to each other without mediacy of said support member.

39. An image forming apparatus comprising:

a rear substrate having an electron-emitting device;

a front substrate having an image forming member; and a support member for maintaining an interval between said rear substrate and said front substrate, wherein said support member has an electrode, which is provided toward said rear substrate from a predetermined position, for applying a deflection force in a direction away from said support member to an electron emitted by said electron-emitting device, the distance between said rear substrate and said front substrate is 0.5 mm to 10 mm, a size of a pixel formed on said image forming member upon reception of an emitted electron is 100 μm to 1 mm, an accelerating voltage for accelerating an electron emitted by said electron-emitting device is 1 to 15 kV, the distance between said predetermined position and said rear substrate is not more than ¼ of the distance between said rear substrate and said front substrate, and said support member has an area having a sheet resistance larger than $10^{12}$ Ω/sq between said predetermined position and a terminal portion of said front substrate side.

40. The apparatus according to claim 39, wherein the distance between said predetermined position and said rear substrate is not less than 1/20 of the distance between said rear substrate and said front substrate.

41. The apparatus according to claim 39, wherein said electrode is provided from said predetermined position to a terminal portion of said rear substrate side.

42. The apparatus according to claim 39, wherein said electrode is also arranged on an abutment surface of said support member against said rear substrate.

43. The apparatus according to claim 39, wherein said electrode is connected to wiring arranged on said rear substrate.

44. The apparatus according to claim 43, wherein said wiring is for connecting said electron-emitting device.

45. An image forming apparatus comprising:

a rear substrate having an electron-emitting device;

a front substrate having an image forming member; and a support member for maintaining an interval between said rear substrate and said front substrate, wherein said support member has an electrode, which is provided toward said rear substrate from a predetermined position and is electrically connected to wiring connected to said electron emitting device, the distance between said rear substrate and said front substrate is 0.5 mm to 10 mm, a size of a pixel formed on said image forming member upon reception of an emitted electron is 100 μm to 1 mm, an accelerating voltage for accelerating an electron emitted by said electron-emitting device is 1 to 15 kV, the distance between said predetermined position and said rear substrate is not more than ¼ of the distance between said rear substrate and said front substrate, and said support member has an area having a sheet resistance larger than $10^{12}$ Ω/sq between said predetermined position and a terminal portion of said front substrate side.

46. The apparatus according to claim 45, wherein the distance between said predetermined position and said rear substrate is not less than 1/20 of the distance between said rear substrate and said front substrate.

47. The apparatus according to claim 45, wherein said electrode is provided from said predetermined position to a terminal portion of said rear substrate side.

48. The apparatus according to claim 45, wherein said electrode is also arranged on an abutment surface of said support member against said rear substrate.

49. An image forming apparatus comprising:

a rear substrate having an electron-emitting device;

a front substrate having an image forming member; and a support member for maintaining an interval between said rear substrate and said front substrate, wherein said support member has an electrode, which is provided toward said rear substrate from a prdedetermined position, for applying a deflection force in a direction away from said support member to an electron emitted by said electron-emitting device, the distance between said rear substrate and said front substrate is 0.5 mm to 10 mm, an acceleration voltage for accelerating an electron emitted by said electron-emitting device is 1 to 15 kV, the distance between said predetermined position and said rear substrate is not more the ¼ and not less than 1/20 of the distance between said rear substrate and said front substrate, and said support member has an area having a sheet resistance larger than $10^{12}$ Ω/sq between said predetermined position and a terminal portion of said front substrate side.

50. The apparatus according to claim 49, wherein said electrode is provided from said predetermined position to a terminal portion of said rear substrate side.

51. The apparatus according to claim 49, wherein said electrode is also arranged on an abutment surface of said support member against said rear substrate.

52. The apparatus according to claim 49, wherein said electrode is connected to wiring arranged on said rear substrate.

53. The apparatus according to claim 52, wherein said wiring is for connecting said electron-emitting device.

54. An image forming apparatus comprising:

a rear substrate having an electron-emitting device;

a front substrate having an image forming member; and a support member for maintaing an interval between said rear substrate and said front substrate, wherein said support member has an electrode, which is provided toward said rear substrate from a predetermined position and is electrically connected to wiring connected to said electron emitting device;

the distance between said rear substrate and said front substrate is 0.5 mm to 10 mm, an acceleration voltage for accelerating an electron emitted by said electron-emitting device si 1 to 15 kV, the distance between said predetermined position and said rear substrate is not more than ¼ and is less than 1/20 of the distance between said rear substrate and said front substrate, and said support member has an area having a sheet resistance larger the $10^{12}$ Ω/sq between said predetermined position and a terminal portion of said front substrate side.

55. The apparatus according to claim 54, wherein said electrode is provided from said predetermined position to a terminal portion of said rear substrate side.

56. The apparatus according to claim 54, wherein said electrode is also arranged on an abutment surface of said support member against said rear substrate.

* * * * *

UNITED STATES PATENT AND TRADEMARK OFFICE

CERTIFICATE OF CORRECTION

PATENT NO. : 6,351,065 B2
DATED : February 26, 2002
INVENTOR(S) : Koji Yamazaki et al.

It is certified that error appears in the above-identified patent and that said Letters Patent is hereby corrected as shown below:

Title page,
Item [56], References Cited, U.S. PATENT DOCUMENTS,
"5,987,067 11/1999 Schmid et al." should read
-- 5,985,067 11/1999 Schmid et al. --.
"5,742,177 A 4/1998 Spindt et al." should be deleted.

Item [57], ABSTRACT,
Line 13, "close" should read -- closer --.

Column 3,
Line 64,"symbolsDx1" should read -- symbols Dx1 --.

Column 14,
Line 10, "SEC" should read -- SCE --.

Column 18,
Line 6, "12 04," should read -- 1204, --.

Column 20,
Line 21, "ofn" should read -- of n --.

Column 24,
Line 11, "andN" should read -- and N --.

Column 27,
Line 35, "that" should read -- than --.

Column 28,
Line 1, "claim 2," should read -- claim 12, --.

Column 29,
Line 33, "an" should read -- an electron --.

UNITED STATES PATENT AND TRADEMARK OFFICE

CERTIFICATE OF CORRECTION

PATENT NO. : 6,351,065 B2
DATED : February 26, 2002
INVENTOR(S) : Koji Yamazaki et al.

It is certified that error appears in the above-identified patent and that said Letters Patent is hereby corrected as shown below:

Column 32,
Line 17, "si" should read -- is --.

Signed and Sealed this

Eighth Day of October, 2002

*Attest:*

*Attesting Officer*

JAMES E. ROGAN
*Director of the United States Patent and Trademark Office*